US012292267B1

(12) United States Patent
Small

(10) Patent No.: US 12,292,267 B1
(45) **Date of Patent: *May 6, 2025**

(54) AMMO BOX FILLING TOOL

(71) Applicant: Roger Elliot Small, Pegram, TN (US)

(72) Inventor: Roger Elliot Small, Pegram, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/623,613

(22) Filed: Apr. 1, 2024

Related U.S. Application Data

(63) Continuation of application No. 17/708,184, filed on Mar. 30, 2022, now Pat. No. 11,976,910.

(51) Int. Cl.
*F42B 39/26* (2006.01)

(52) U.S. Cl.
CPC ..... *F42B 39/26* (2013.01)

(58) Field of Classification Search
CPC ..... F42B 39/26; F42B 99/00
USPC ..... 206/3
See application file for complete search history.

(56) References Cited

U.S. PATENT DOCUMENTS

| | | | |
|---|---|---|---|
| 2,389,285 | A | 11/1945 | Vergobbi |
| 2,928,530 | A | 3/1960 | Sauey |
| 3,593,873 | A | 7/1971 | Vonk |
| 3,813,987 | A | 6/1974 | Minneman |
| D234,495 | S | 3/1975 | Minneman |
| 4,811,836 | A | 3/1989 | Minneman |
| 5,052,549 | A | 10/1991 | Scharch |
| D876,959 | S | 3/2020 | Kedairy |
| 10,697,746 | B2 | 6/2020 | Lutz |
| 11,371,819 | B1 | 6/2022 | Runell |
| 2012/0321431 | A1 | 12/2012 | Riedesel |
| 2020/0224986 | A1 | 7/2020 | Boud |

OTHER PUBLICATIONS

Bragginrights Precision Reloading, "ammo storage box review", Dec. 12, 2017, Entire Video, YouTube,<https://www.youtube.com/watch?v=RGcX-WIUZMQ>.

Bragginrights Precision Reloading, "Ammunition Storage Box Review repackbox.com", Jan. 15, 2018, Entire Video, YouTube, <https://www.youtube.com/watch?v=aomww3C70rl>.

(Continued)

*Primary Examiner* — Jonathan C Weber

(74) *Attorney, Agent, or Firm* — Baker, Donelson, Bearman, Caldwell & Berkowitz, P.C.; Edward D. Lanquist, Jr.; Dominic A. Rota

(57) ABSTRACT

An ammunition box filling tool apparatus and method for filling a pre-folded card stock box having an open top portion with a plurality of units of ammunition is disclosed herein. The ammunition box filling tool apparatus includes a base portion, a perimeter wall extending upwardly from the base portion, a plurality of fingers extending upwardly from the base portion and surrounded by the perimeter wall, and a plurality of sectioned compartments defined one or more of the perimeter wall or the plurality of fingers. Each of the plurality of sectioned compartments is configured receive one of the plurality of units of ammunition. The method includes at least filling ammunition box filling tool apparatus with the plurality of units of ammunition, engaging the open top portion of the pre-folded card stock box with an upper edge of the perimeter wall and simultaneously flipping the two to transfer the ammunition.

15 Claims, 18 Drawing Sheets

(56) References Cited

OTHER PUBLICATIONS

The Gun Bench, "Ammo Boxes—Repackbox.com Review, Keep Your Reloads Organized", Feb. 17, 2019, Entire Video, YouTube, <https://youtu.be/z9w_fhJY4rE>.
Vetterland, "Repack Boxes", May 9, 2021, Entire Video, YouTube, <https://www.youtube.com/watch?v=fDYebwBvJYg>.
Redneck Reloader, "Repackbox product review.", Oct. 22, 2019, Entire Video, YouTube, <https://www.youtube.com/watch?v=VWe_EDJ7XyM>.
Thekkiinngg, "Ammo box Gauge" Feb. 3, 2016, Entire Video, YouTube, <https://www.youtube.com/watch?v=3UTwplwjrfs>.
Repackbox, "Repack Instructional Video", Dec. 6, 2020, Entire Video, YouTube, <https://www.youtube.com/watch?v=RF10Xo2J5HA>.
Repackbox, "Repack Instructional Video . . . ", Oct. 29, 2020, Entire Video, YouTube, <https://www.youtube.com/watch?v=2GDiakEBXrk>.
Repackbox, "Ammo Boxes", Jan. 23, 2022, <https://www.repackbox.com/collections/ammo-boxes-etc>, available at <https://web.archive.org/web/20220123210930/https://www.repackbox.com/collections/ammo-boxes-etc>.
Repackbox, Home Page, Feb. 16, 2022, <https://www.repackbox.com/>, available at <https://web.archive.org/web/20220216213551/https://www.repackbox.com/>.

AMMO BOX FILLING TOOL

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This present application claims priority to, and benefit from, U.S. patent application Ser. No. 17/708,184, entitled "AMMO BOX FILLING TOOL," filed on Mar. 30, 2022, which is hereby incorporated by reference in its entirety.

BACKGROUND

1. Field of the Invention

The present invention relates generally to ammunition storage, for example, in boxes. More particularly, this invention pertains to a tool to assist with filling ammunition in boxes for storage.

2. Description of the Prior Art

Large modern ammunition manufacturers generally rely on very expensive automated box filling equipment for taking bulk quantities of ammunition and placing it into quantity specific boxes for shipping. This packaged ammunition is typically sold in 20, 25, 30, and 50 round boxes.

These boxes, used by these large modern ammunition manufactures, generally consist of a receiving "tray" made of either plastic or styrofoam, and a glued outer "card stock" box into which the filled tray is placed. This type of ammunition packaging is commercially available by special order from various sources.

The automated filling process, used by these large modern ammunition manufactures, requires that the final packaging "trays and boxes" be consistent in size and shape. This consistency allows for predetermined programming of the box filling equipment so that the receiving tray and box are in the right place at the right time in the process. If, otherwise, improperly timed or placed, loose ammunition may be spilled and create a hazardous situation.

The disadvantage of automated box filling equipment is that it requires expensive packaging which is up to 30% larger than needed, generally due to the tray and configuration of the ammunition in the box. Fortunately for these large modern ammunition manufactures, this additional cost is offset by the lower labor cost associated with automated box filling.

An unintended consequence of this up to 30% larger packaging is both the need for additional warehouse storage space and increased shipping charges due to the fact that the cost of shipping a "box" is based upon both its weight and dimensions.

The medium and small "not so modern ammunition manufacturer", does not usually have the financial resources to purchase and employ the expensive automated box filling equipment generally used by large modern ammunition manufacturers.

Accordingly, these medium and small ammunition manufacturers are relegated to using more expensive commercially available ammunition packaging with plastic or styrofoam trays and fill it by hand. The added packaging, labor, and shipping costs place the medium and small ammunition manufacturer at a market disadvantage.

Alternatively, these medium and small ammunition manufacturers may hand load "non-tray" card stock boxes, which do not include a tray for maintaining the ammunition position. The process of hand loading "non-tray" card stock boxes is tedious and time consuming. For example, during the hand filling process, should one of the units of ammunition fall over in the box, the entire box generally had to be emptied and the process started over.

Ammunition box filling tools may also be used by these medium and small ammunition manufacturers to assist in filling "non-tray" card stock boxes. Previous ammunition box filling tools generally included a based and plurality of plastic fingers used to pre-position all of the units of ammunition for a particular card stock box prior to loading the card stock box. Once all of the units of ammunition were pre-positioned in the previous ammunition box filling tool, a folded and open top card stock box is placed over the tool such that the ammunition and tool were positioned within the box. The box is then be flipped over and the tool removed, resulting in a loaded box.

One of the problems associated with these previous ammunition box filling tools is that the fingers are brittle, may easily break during use, and may get stuck inside the box while flipping it. For example, the fingers positioned around the perimeter of previous ammunition box filling tools may catch the edge of the card stock box and break off while attempting to insert the open top of the card stock box over the tool and ammunition. Further, for example, the fingers may get stuck inside the card stock box and/or pinch certain units of ammunition therebetween such that the certain units do not freely fall into the box when it is flipped, thus causing the loading process to necessarily be restarted.

BRIEF SUMMARY

In view of at least some of the above-referenced problems surrounding previous ammunition box filling tools, an exemplary object of the present disclosure may be to provide new and improved ammunition box filling tool apparatuses and methods for loading "non-tray" card stock boxes using the improved ammunition box filling tool apparatus. The improved ammunition box filling tool apparatus may enable the medium and small ammunition manufacturers to use lower cost, commercially available, flat, foldable, "non tray" card stock boxes. Additionally, because these boxes are smaller, there may reduce the warehouse storage requirements and avoid the increased shipping costs associated with tray boxes, which are generally 30% larger while holding the same number of units of ammunition.

An exemplary such apparatus may desirably feature a plurality of sectioned compartments, each configured to receive individual units of ammunition. The number of sectioned compartments may be dictated by the size of the card stock box, for example, such that the number of sectioned compartments is 20, 25, 30, 50, or the like. The plurality of sectioned compartments may be specifically dimensioned caliber specific sectioned compartments that are configured to hold the ammunition in an upright position.

The exemplary such apparatus may further feature a perimeter wall surrounding the plurality of sectioned compartments. The perimeter wall may be configured in conjunction with the plurality of sectioned compartments to keep the units of ammunition in an upright position. An exemplary such aspect of the perimeter may include an upper exterior chamfered edge configured to engage the pre-folded open top of the card stock box, such that the improved ammunition box filling tool apparatus engages the opening rather than being received by the opening. Accordingly, the perimeter wall may act as a "stop" and "leveling guide" for the edges of the card stock box so that the upright ammunition units can fall evenly into the box when it is flipped upside down to receive the units of ammunition from the improved ammunition box filling tool apparatus.

In a particular embodiment, an exemplary ammunition box filling tool apparatus as disclosed herein may include a squaroid base portion, a perimeter wall extending upwardly from the squaroid base portion, a plurality of fingers extending upwardly from the squaroid base portion and surrounded by the perimeter wall, and a plurality of sectioned compartments defined by at least one of the perimeter wall or one or more of the plurality of fingers. Each of the plurality of sectioned compartments may be configured receive one of the plurality of units of ammunition.

In an exemplary aspect according to the above-referenced embodiment, at least one of the plurality of sectioned compartments may be defined at least in part by a portion of an interior surface of the perimeter wall.

In another exemplary aspect according to the above-referenced embodiment, the perimeter wall may include an exterior surface having an upper chamfered edge configured to engage the open top portion of the pre-folded card stock box.

In another exemplary aspect according to the above-referenced embodiment, the plurality of sectioned compartments may be arranged in a square grid pattern including a plurality of rows and a plurality of columns oriented perpendicularly to the plurality of rows.

In another exemplary aspect according to the above-referenced embodiment, each of the plurality of sectioned compartments may be one of a first sectioned compartment type or a second sectioned compartment type. The first sectioned compartment type may be configured to receive a nose of one of the plurality of units of ammunition. The second sectioned compartment type may be configured to receive a base of the one of the plurality of units of ammunition.

In another exemplary aspect according to the above-referenced embodiment, a bottom portion of the first sectioned compartment type may be conically shaped for receiving the nose of one of the plurality of units of ammunition. In accordance with this embodiment, a bottom portion of the second sectioned compartment type may be flat and may include a widened back-relief to provide additional clearance for the base of one of the plurality of units of ammunition.

In another exemplary aspect according to the above-referenced embodiment, the bottom portion of the first sectioned compartment type may be positioned closer to an upper edge of the perimeter wall than the bottom portion of the second sectioned compartment type.

In another exemplary aspect according to the above-referenced embodiment, the bottom portions of each of the first and second sectioned compartment types may include a hole, respectively, defined through the squaroid base portion. The hole of the first sectioned compartment type may be smaller than the hole of the second sectioned compartment type.

In another exemplary aspect according to the above-referenced embodiment, a portion of each of the perimeter wall or the plurality of fingers used to define one of the first sectioned compartment type or the second sectioned compartment type may be curved to match a portion of a cylindrical shape of each of the plurality of units of ammunition.

In another exemplary aspect according to the above-referenced embodiment, an upper end of each of the plurality of fingers may include a tapered portion facing the first sectioned compartment type and configured to receive a shoulder of one of the plurality of units of ammunition. In accordance with this embodiment, the portion of the perimeter wall used to define the first sectioned compartment type may include a curved ledge configured to receive the shoulder of one of the plurality of units of ammunition.

In another exemplary aspect according to the above-referenced embodiment, the plurality of sectioned compartments within each row of the plurality of rows may all be of one of the first sectioned compartment type or the second sectioned compartment type. In accordance with this embodiment, the square grid pattern may at least partially be defined by alternating from the first sectioned compartment type to the second sectioned compartment type between adjacent rows of the plurality of rows.

In another exemplary aspect according to the above-referenced embodiment, the square grid pattern may at least partially be defined by alternating between the first and second sectioned compartment types within each row of the plurality of rows and within each column of the plurality of columns.

In another exemplary aspect according to the above-referenced embodiment, the plurality of sectioned compartments may all be of the first sectioned compartment type In another exemplary aspect according to the above-referenced embodiment, each of the plurality of fingers may include a plurality of concave sidewalls.

In another exemplary aspect according to the above-referenced embodiment, the perimeter wall may include a pair of cutaway portions positioned along an upper portion of the perimeter wall opposite each other. The pair of cutaway portions may be defined between an interior surface and an exterior surface of the perimeter wall. In accordance with this embodiment, the pair of cutaway portions may be configured to provide clearance for portions of a pair of interlocking arms of the pre-folded card stock box that extend above open top portion.

In another embodiment, a method of loading a pre-folded card stock box having an open top portion with a plurality of units of ammunition using an ammunition box filling tool apparatus is disclosed herein. The method may include (a) filling the ammunition box filling tool apparatus with the plurality of units of ammunition; (b) engaging the open top portion of the pre-folded card stock box with an upper chamfered edge of a perimeter wall of the ammunition box filling tool apparatus; and (c) flipping the ammunition box filling tool apparatus into an upside-down position while maintaining contact between the open top portion and the upper chamfered edge such that the units of ammunition are transferred from the ammunition box filling tool apparatus to the pre-folded card stock box.

In an exemplary aspect according to the above-referenced embodiment, the method may further comprise, after step (c), disengaging the ammunition box filling tool apparatus from the pre-folded card stock box, and folding closed the open top portion of the pre-folded card stock box.

In another exemplary aspect according to the above-referenced embodiment, step (a) of the method may further comprise positioning each of the plurality of units of ammunition into a plurality of sectioned compartments of the ammunition box filling tool apparatus, wherein each of the plurality of sectioned compartments is defined by at least one of the perimeter wall or one or more of a plurality of fingers of the ammunition box filling tool apparatus.

In another exemplary aspect according to the above-referenced embodiment, step (a) of the method may further comprise receiving a nose of each of the plurality of units of ammunition into sectioned compartments of a first sectioned compartment type of the plurality of section compartments.

In another exemplary aspect according to the above-referenced embodiment, step (a) of the method may further comprise receiving a base of each of the plurality of units of ammunition into sectioned compartments of a second sectioned compartment type of the plurality of section compartments.

DETAILED DESCRIPTION

Figure 1A:
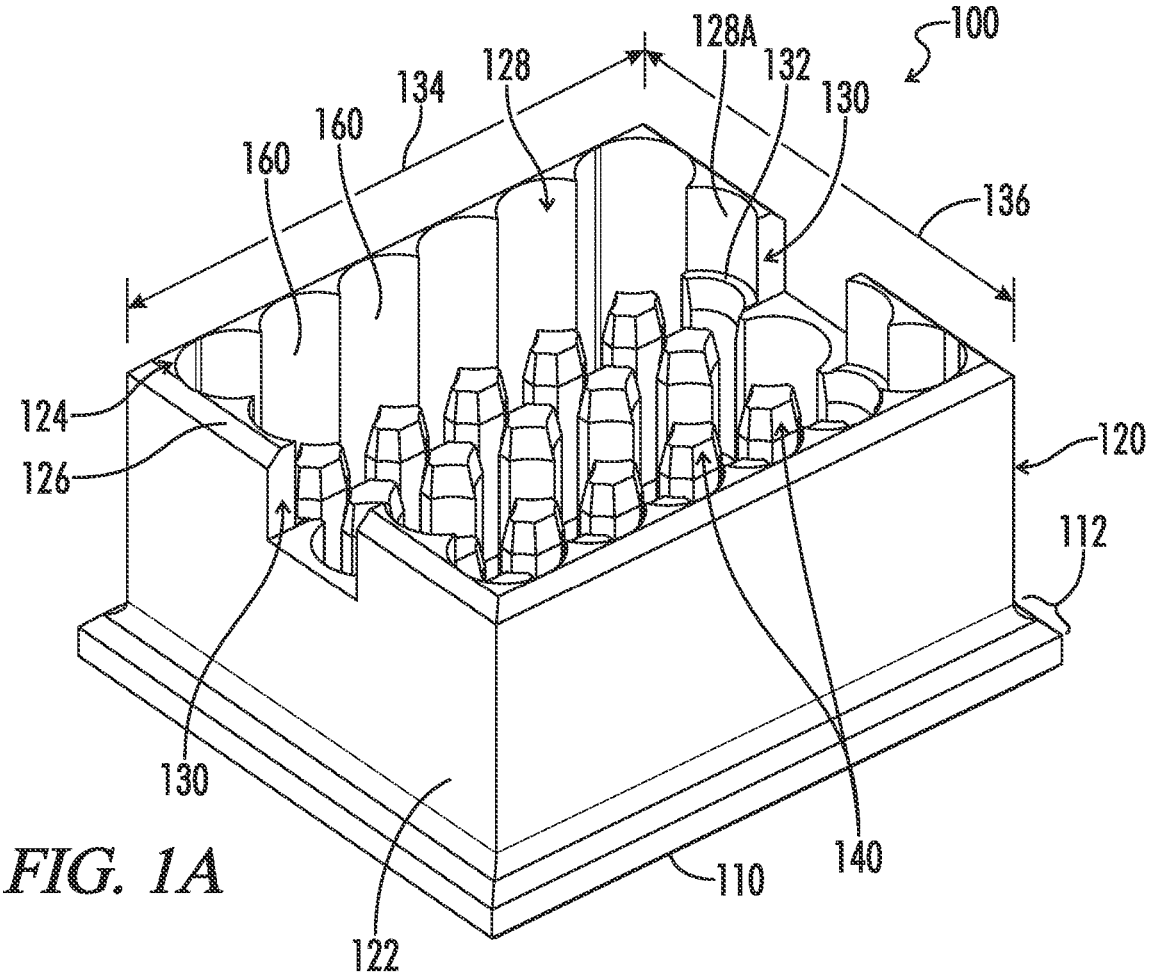
FIG. 1A is a perspective view of an embodiment of an ammunition box filling tool apparatus in accordance with the present disclosure.
Figure 1B:
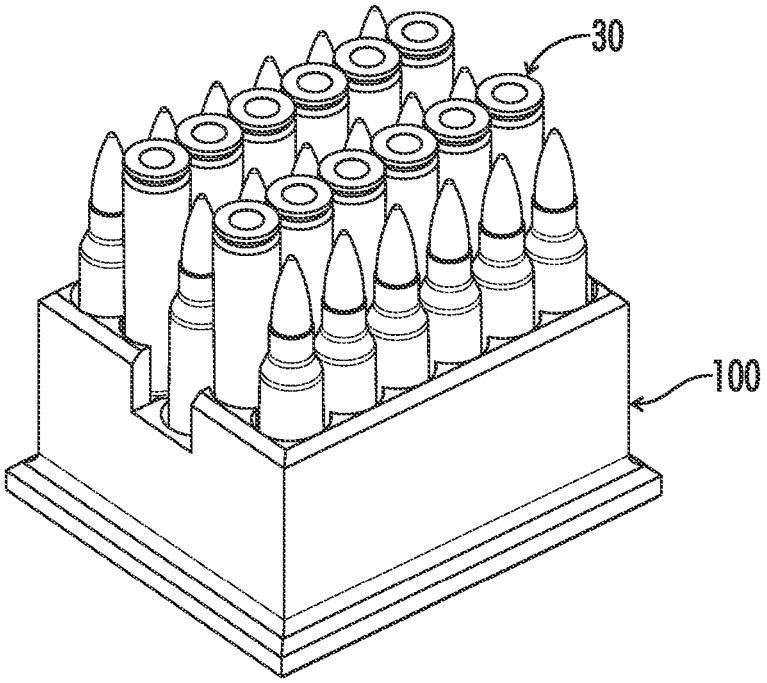
FIG. 1B is a perspective view of the ammunition box filling tool apparatus of FIG. 1A filled with ammunition in accordance with the present disclosure.
Figure 2:
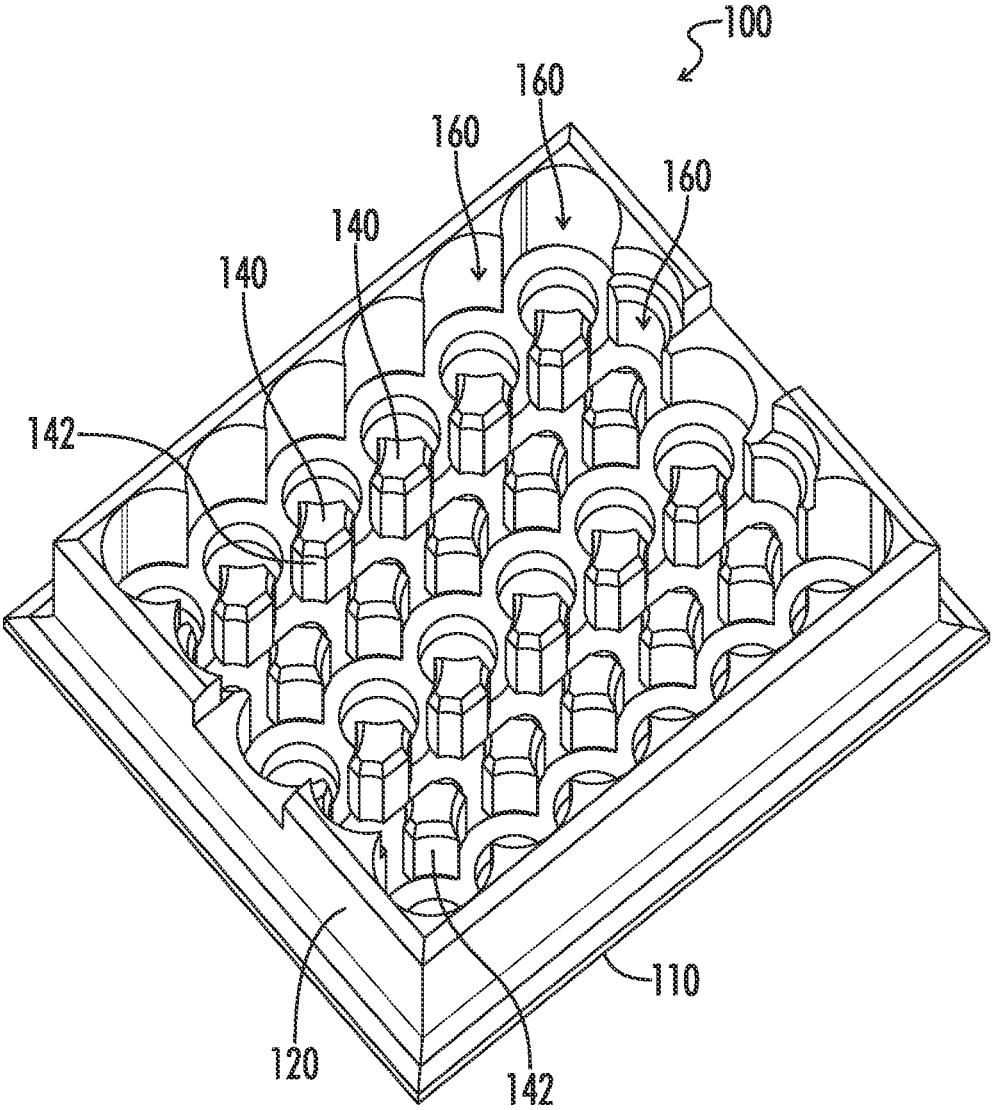
FIG. 2 is an elevated perspective view of the ammunition box filling tool apparatus of FIG. 1A in accordance with the present disclosure.
Figure 3:
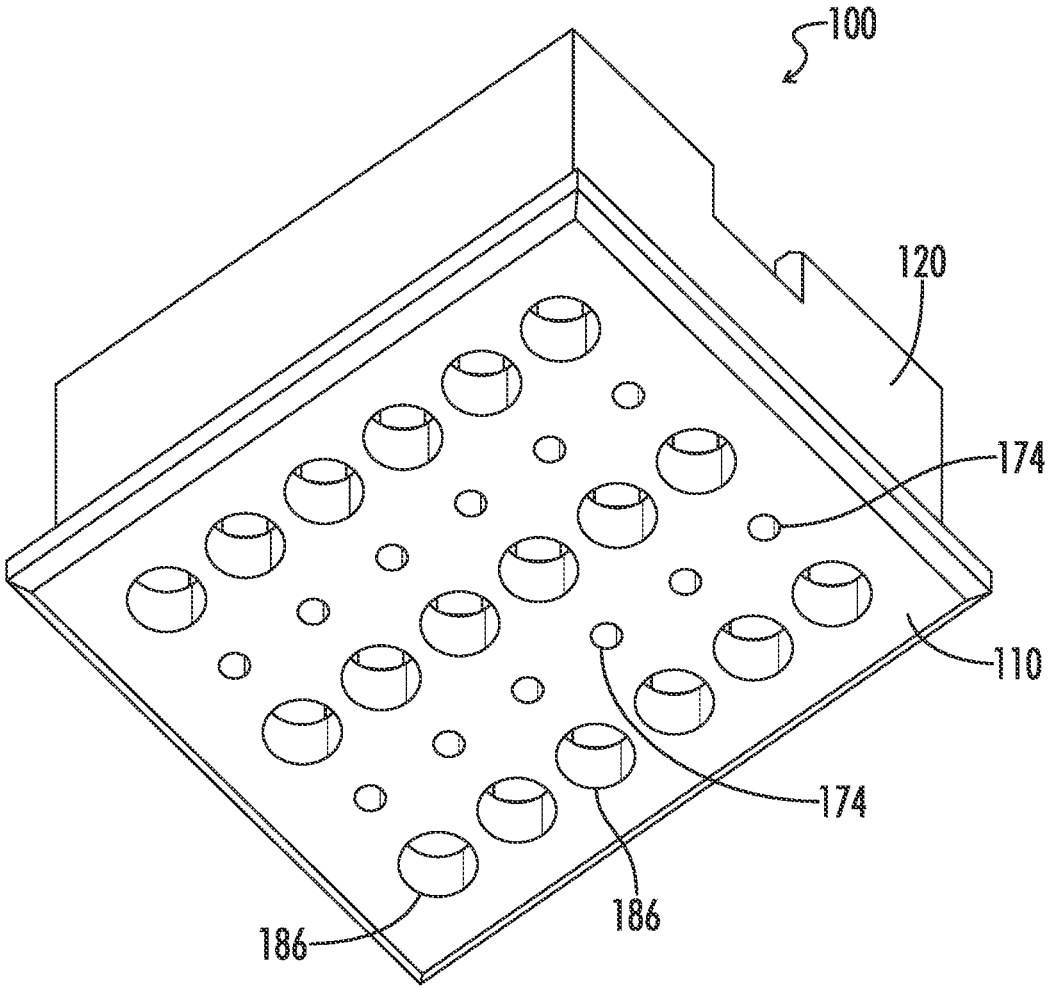
FIG. 3 is a bottom perspective view of the ammunition box filling tool apparatus of FIG. 1A in accordance with the present disclosure.

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

The words "connected", "attached", "joined", "mounted", "fastened", and the like should be interpreted to mean any manner of joining two objects including, but not limited to, the use of any fasteners such as screws, nuts and bolts, bolts, pin and clevis, and the like allowing for a stationary, translatable, or pivotable relationship; welding of any kind such as traditional MIG welding, TIG welding, friction welding, brazing, soldering, ultrasonic welding, torch welding, inductive welding, and the like; using any resin, glue, epoxy, and the like; being integrally formed as a single part together; any mechanical fit such as a friction fit, interference fit, slidable fit, rotatable fit, pivotable fit, and the like; any combination thereof; and the like.

Unless specifically stated otherwise, any part of the apparatus of the present disclosure may be made of any appropriate or suitable material including, but not limited to, metal, alloy, polymer, polymer mixture, wood, composite, or any combination thereof.

Referring to FIGS. 1A-19, several embodiments of an ammunition box filling tool apparatus 100 is shown. The ammunition box filling tool apparatus 100 may also be referred to herein as an ammunition box filling tool 100 or an apparatus 100. The ammunition box filling tool apparatus 100 is configured for filling a pre-folded card stock box 10 (shown in FIGS. 20A and 20B) with a plurality of units of ammunition 30 (shown in FIGS. 1B, 8, 9B, and 16A-16B).

The plurality of units of ammunition 30 may also be referred to herein as units of ammunition 30, a plurality of cartridges 30, or cartridges 30. Pertinent parts of the units of ammunition 30, which will be referred to herein, include the base 32, the shoulder 34, and the nose 36. The base 32 and the shoulder 34 are part of the casing of each of the units of ammunition 30 while the nose 36 is part of the bullet of each of the units of ammunition 30 which is projected from the case. The ammunition box filling tool apparatus 100 may be configured to receive units of ammunition 30 that are of a rifle caliber or of a pistol caliber. The pistol caliber units of ammunition 30 may not include the shoulder 34.

Figure 20A:
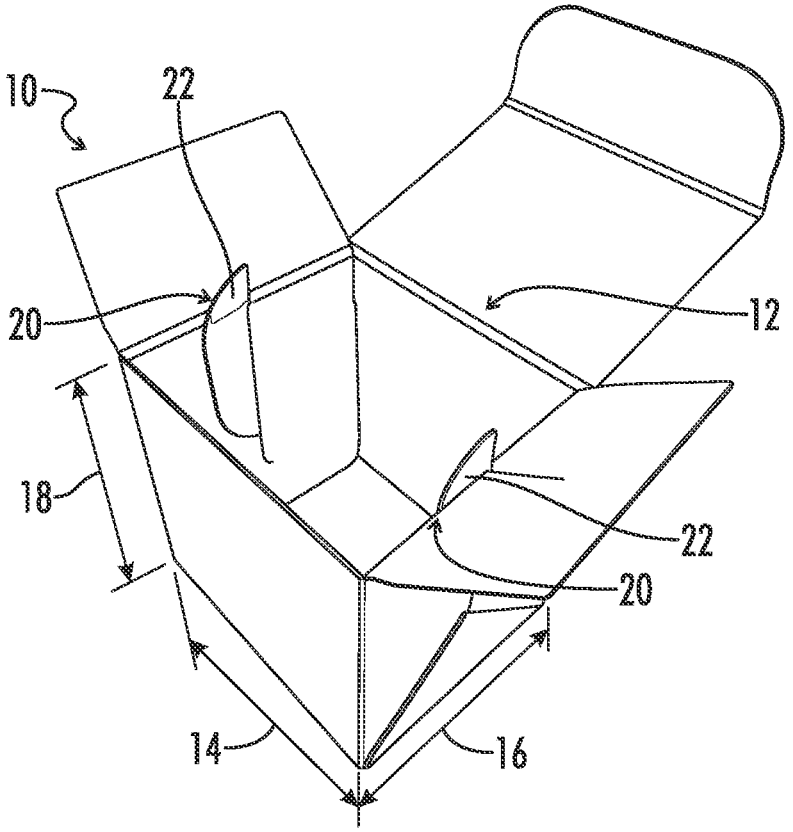
FIG. 20A is a perspective view of an embodiment of a pre-folded card stock box sized for receiving a plurality of rifle caliber units of ammunition in accordance with the present disclosure.
Figure 20B:
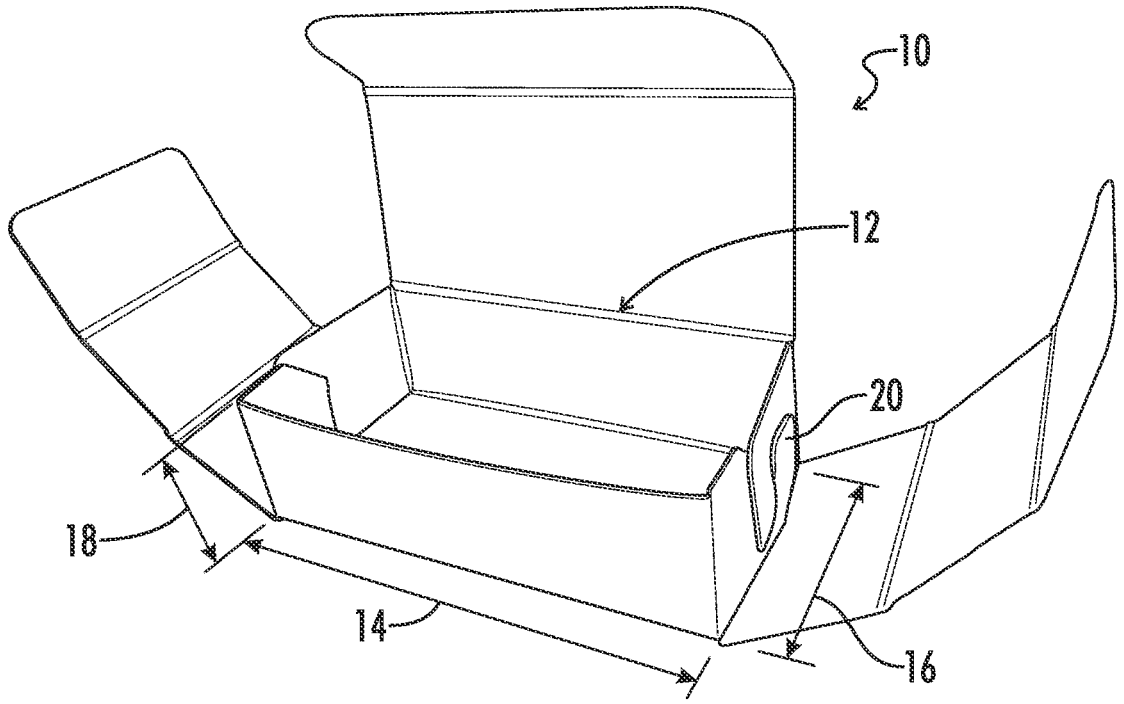
FIG. 20B is a perspective view of an embodiment of a pre-folded card stock box sized for receiving a plurality of pistol caliber units of ammunition in accordance with the present disclosure.

Referring to FIGS. 20A-20B, the pre-folded card stock box 10 may include an open top portion 12, a length 14, a width 16, and a height 18. The pre-folded card stock box 10 may also be referred to herein as a card stock box 10. The pre-folded card stock box 10 may be delivered to a user in a non-folded state and may have to be manually assembled (or folded) by a user such that the open top portion 12 is defined prior to filling with units of ammunition 30 using, for example, the ammunition box filling tool apparatus 100. In certain optional embodiments, such as that shown in FIG. 20A, the pre-folded card stock box 10 may include a pair of interlocking arms 20 used to hold the card stock box 10 in the folded (or pre-folded) configuration. A portion 22 of each of the pair of interlocking arms 20 may extend above the open top portion 12.

Referring back to FIGS. 1A-19, the ammunition box filling tool apparatus 100 may include a squaroid base portion 110 and a perimeter wall 120 extending upwardly (or perpendicularly) from the squaroid base portion 110. The squaroid base portion 110 may also be referring to herein as a base portion 110. In certain optional embodiments, the squaroid base portion 110 may be shaped, for example, as a square, rectangle, or any other shape that matches a shape of the open top portion 12 of the pre-folded card stock box 10. The rectangular base portion 110 may include a ledge 112 extending beyond an exterior surface 122 of the perimeter wall 120. The ledge 112 may be used by a user for more easily grasping and manipulating the ammunition box filling tool apparatus 100.

The perimeter wall 120 may further include an upper portion 124 defined opposite the base portion 110. The upper portion 124 may also be referred to herein as an upper edge 124. The upper portion 124 may include a chamfered edge 126 configured to engage the open top portion 12 of the pre-folded card stock box 10. The chamfered edge 126 may also be referred to herein as an upper chamfered edge 126. The chamfered edge 126 may be at least partially defined along the exterior surface 122 of the perimeter wall 120. In other optional embodiments (not shown), the upper portion 124 be configured to engage the open top portion 12 of the pre-folded card stock box 10 without the chamfered edge 126, or alternatively, using a trough (not shown) defined therein and shaped to receive at least a portion of the open top portion 12 of the pre-folded card stock box 10 for maintaining alignment of the open top portion 12 of the pre-folded card stock box 10 with the ammunition box filling tool apparatus 100.

The exterior surface 122 of the perimeter wall 120 may include a 134 and a width 136 which may be relationally related to the dimensions of the pre-folded card stock box 10. The length of the exterior surface 122 may be greater than or equal to the length 14 of the pre-folded card stock box 10. Similarly, the width 136 of the exterior surface 122 may be greater than or equal to the width 16 of the pre-folded card stock box 10. This relationship ensures that the open top portion 12 of the card stock box 10 cannot receive the perimeter wall 120 when transferring the plurality of units of ammunition 30 from the ammunition box filling tool apparatus 100 to the pre-folded card stock box 10. This relationship also enables the interaction between the upper portion 124 of the perimeter wall 120 and the open top portion 12 of the card stock box 10. Further, this relationship ensures that the plurality of units of ammunition 30 once transferred from the ammunition box filling tool apparatus 100 to the pre-folded card stock box 10 fit snugly or have little excess room within the pre-folded card stock box 10 such that the plurality of units of ammunition 30 maintain their positions relative to one another.

In certain optional embodiments, the perimeter wall 120 may include a pair of cutaway portions 130 defined between an interior surface 128 and the exterior surface 122 and positioned along the upper portion 124 of the perimeter wall 120 opposite each other. Each cutaway portion of the pair of cutaway portions 130 may be configured to provide clearance for the portions 22 of the pair of interlocking arms 20 of the pre-folded card stock box 10 that extend above the open top portion 12 such that the portions 22 do not interfere with any interaction or engagement between the upper portion 124 of the perimeter wall 120 and the open top portion 12 of the pre-folded card stock box 10.

The ammunition box filling tool apparatus 100 may further include a plurality of fingers 140 extending upwardly (or perpendicularly) from the base portion 110 in a same direction as the perimeter wall 120 such that the plurality of fingers 140 are surround by the perimeter wall 120. Each of the plurality of fingers 140 may include a plurality of concave sidewalls 142. The plurality of concave sidewalls 142 may define concave cross-sectional shape (not labeled) which may be a circular shape, a triangular shape, a quadrilateral shape, a pentagonal shape, a hexagonal shape, a heptagonal shape, an octagonal shape, or the like. In certain optional embodiments (not shown), the plurality of fingers 140 may have a circular cross-sectional profile, may be cylindrically shaped, or may be any shape of a prism. The concave shape of each side of the plurality of fingers 140 may be shaped to match a portion of the cylindrical shape of each of the plurality of units of ammunition 30.

The ammunition box filling tool apparatus 100 may further include a plurality of sectioned compartments 160 defined by at least one of the perimeter wall 120 or one or more of the plurality of fingers 140. Each of the plurality of sectioned compartments 160 may be configured to receive one of the plurality of units of ammunition 30. At least one of the plurality of sectioned compartments 160 may be defined at least in part by an interior surface 128 of the perimeter wall 120. At least one of the plurality of sectioned compartments 160 may be defined exclusively by one or more of the plurality of fingers 140.

Figure 4:
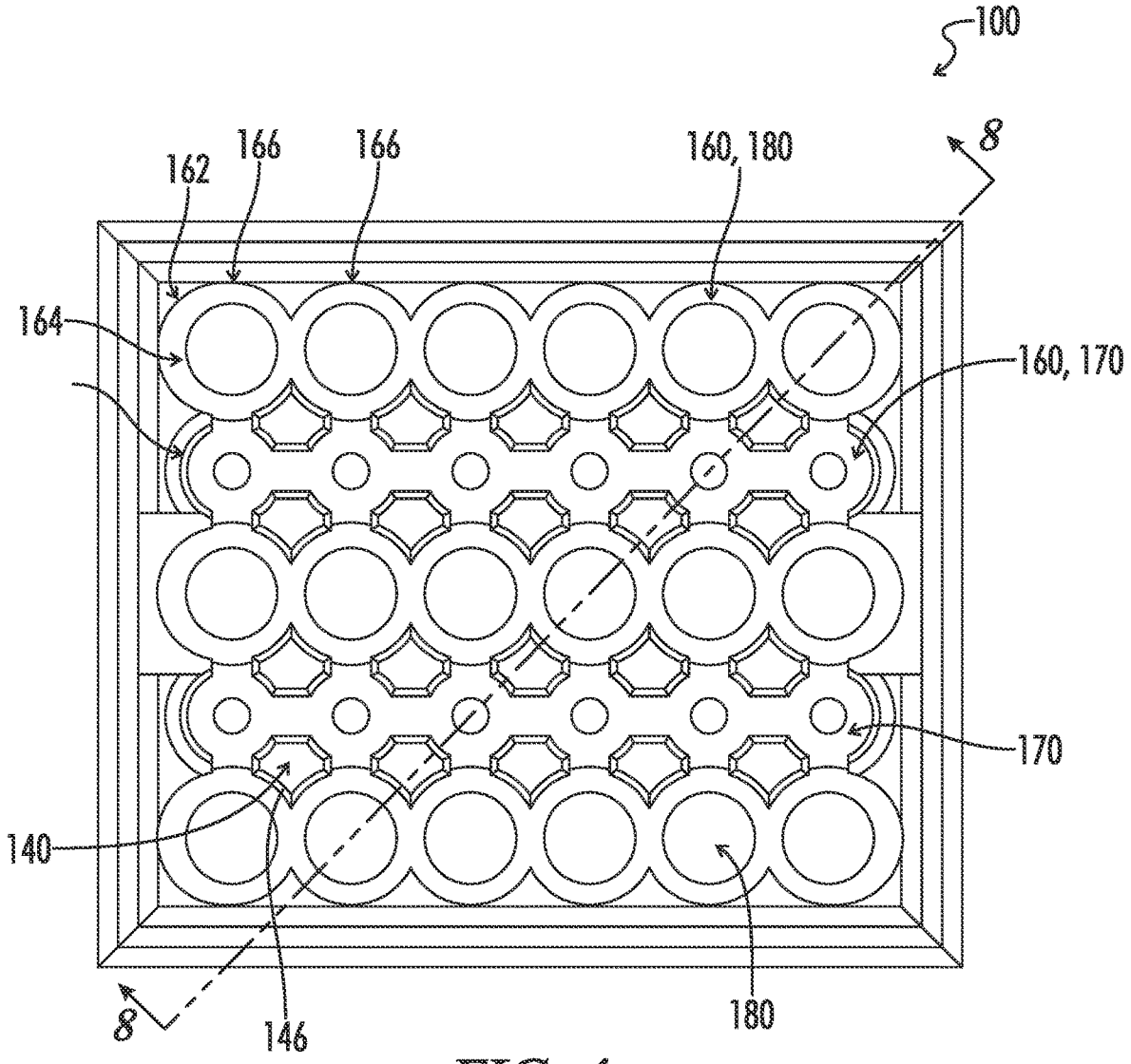
FIG. 4 is a top plan view of the ammunition box filling tool apparatus of FIG. 1A in accordance with the present disclosure.
Figure 5:
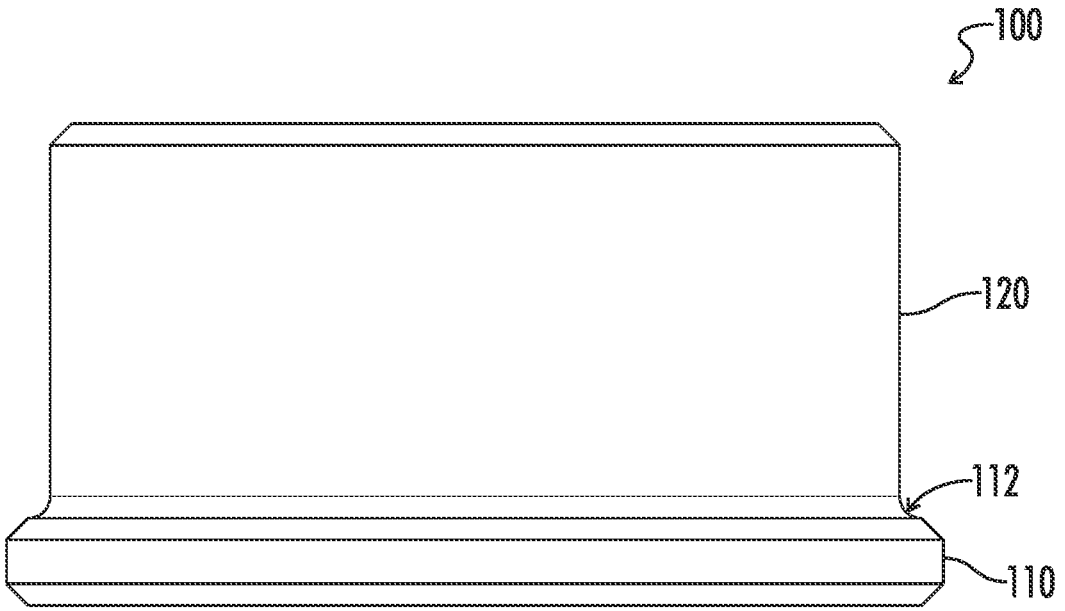
FIG. 5 is a front elevation view of the ammunition box filling tool apparatus of FIG. 1A in accordance with the present disclosure, the rear elevation view being an identical mirror image thereto.
Figure 6:
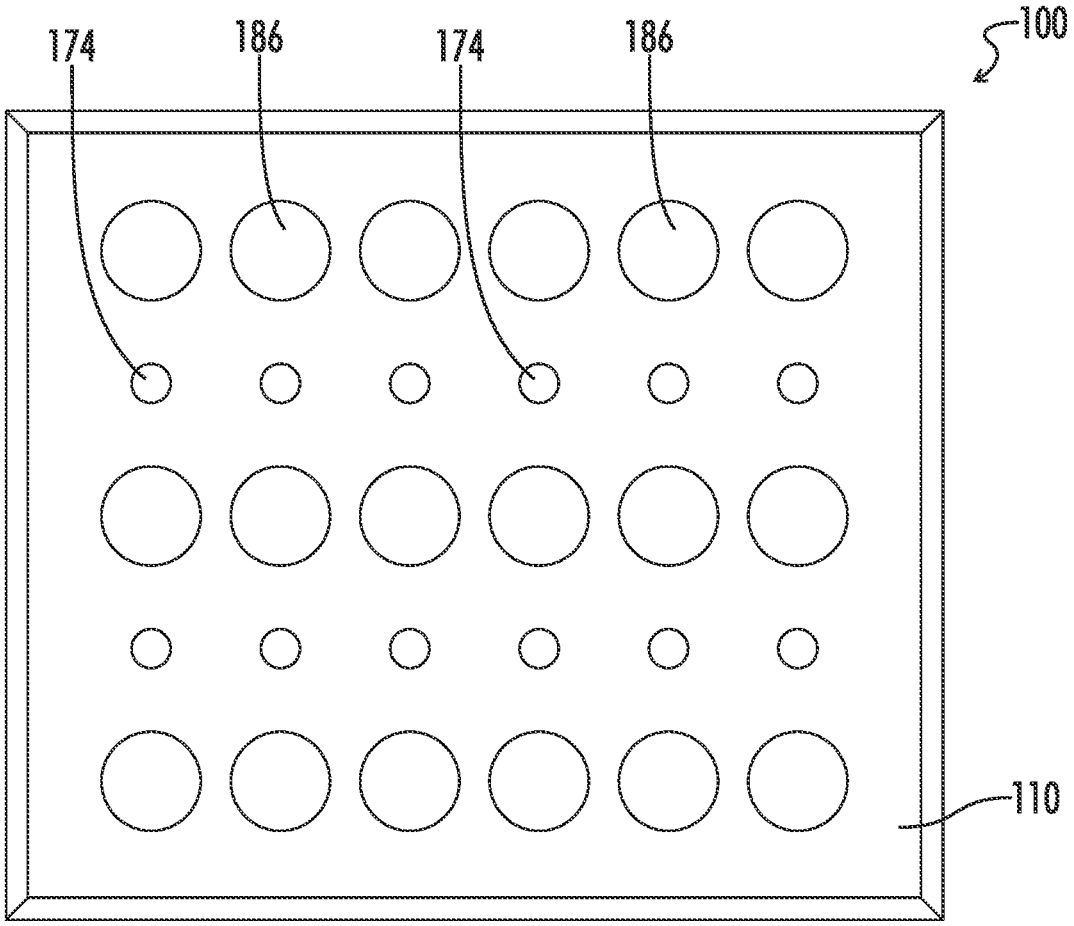
FIG. 6 is a bottom plan view of the ammunition box filling tool apparatus of FIG. 1A in accordance with the present disclosure.
Figure 7:
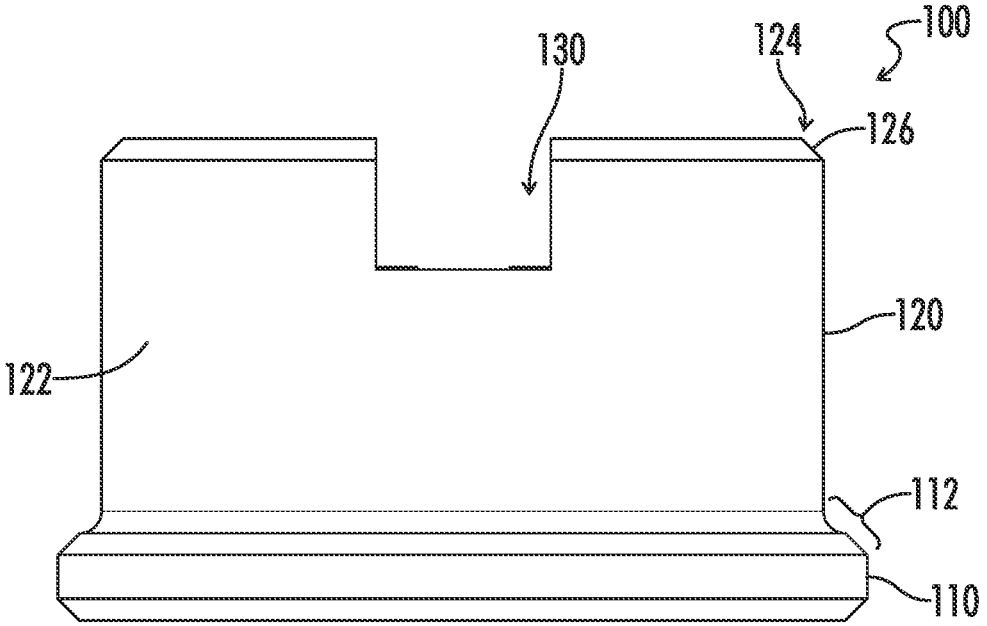
FIG. 7 is a left side elevation view of the ammunition box filling tool apparatus of FIG. 1A in accordance with the present disclosure, the right side elevation view being an identical mirror image thereto.
Figure 12:
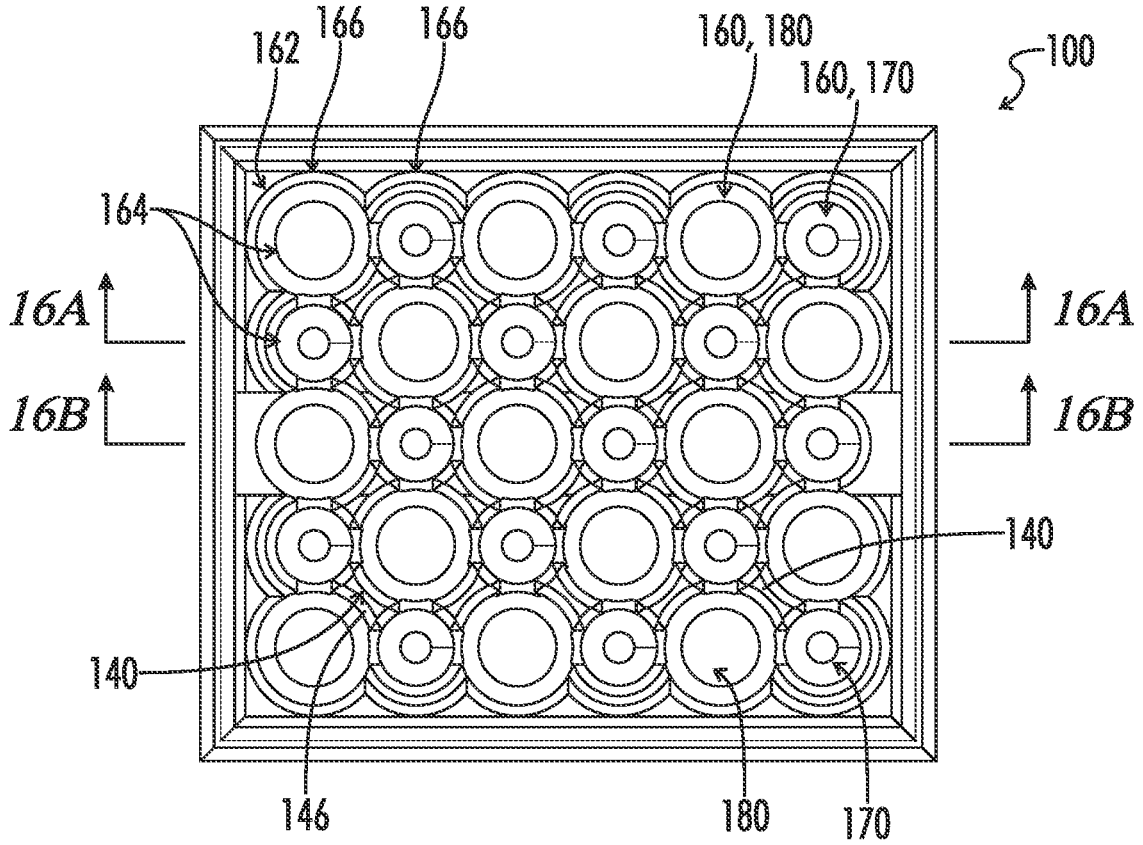
FIG. 12 is a top plan view of the ammunition box filling tool apparatus of FIG. 9A in accordance with the present disclosure.
Figure 13:
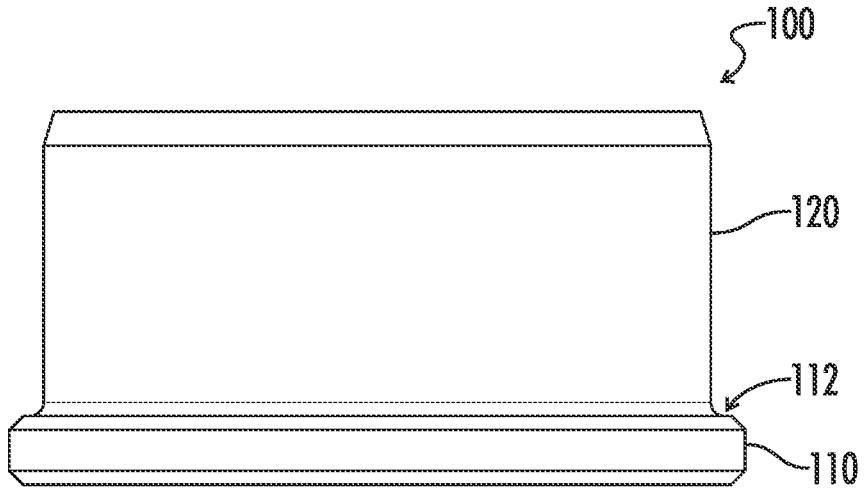
FIG. 13 is a front elevation view of the ammunition box filling tool apparatus of FIG. 9A in accordance with the present disclosure, the rear elevation view being an identical mirror image thereto.
Figure 14:
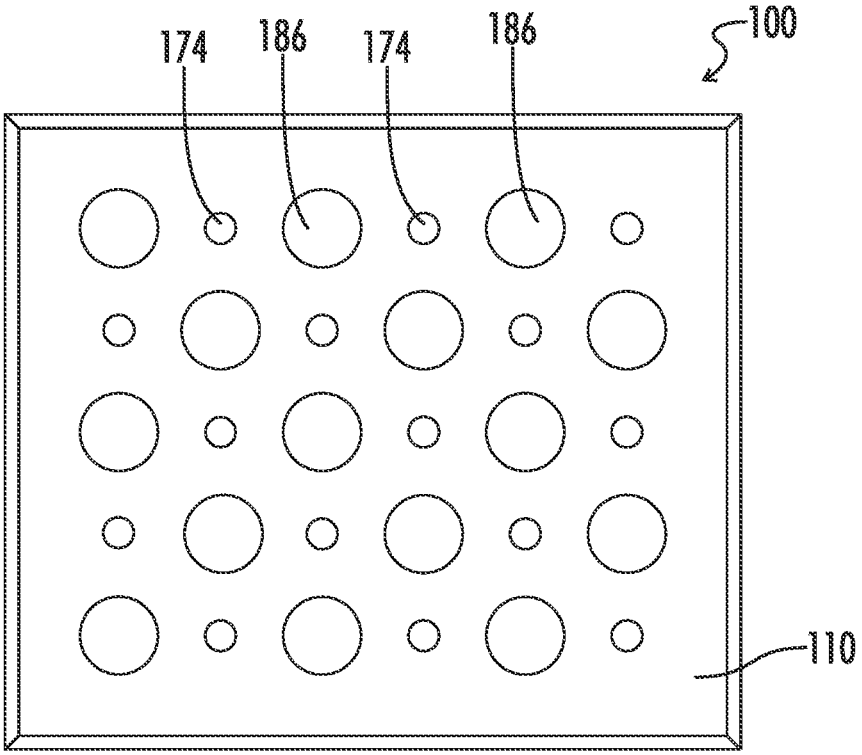
FIG. 14 is a bottom plan view of the ammunition box filling tool apparatus of FIG. 9A in accordance with the present disclosure.
Figure 15:
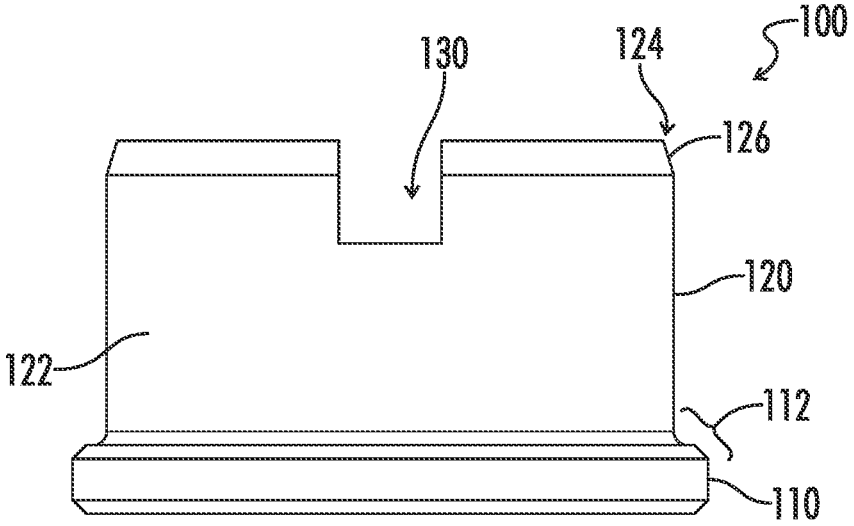
FIG. 15 is a left side elevation view of the ammunition box filling tool apparatus of FIG. 9A in accordance with the present disclosure, the right side elevation view being an identical mirror image thereto.
Figure 18:
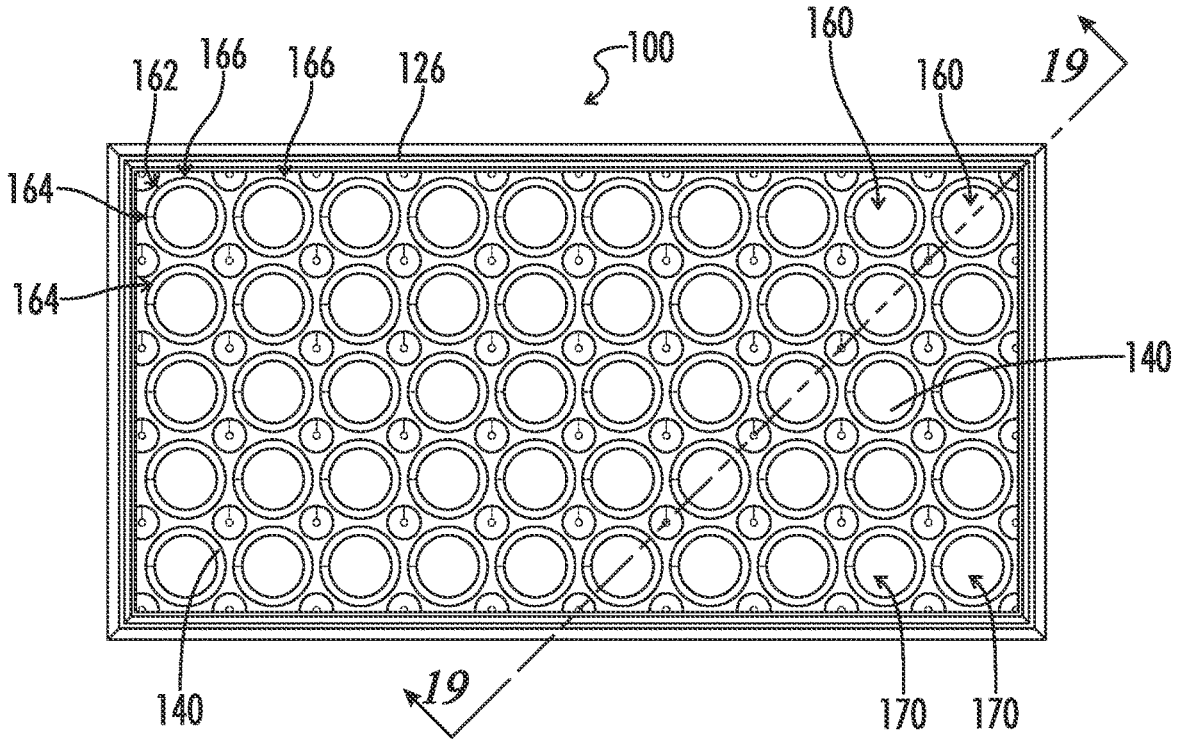
FIG. 18 is a top plan view of the ammunition box filling tool apparatus of FIG. 17A in accordance with the present disclosure.
Figure 19:
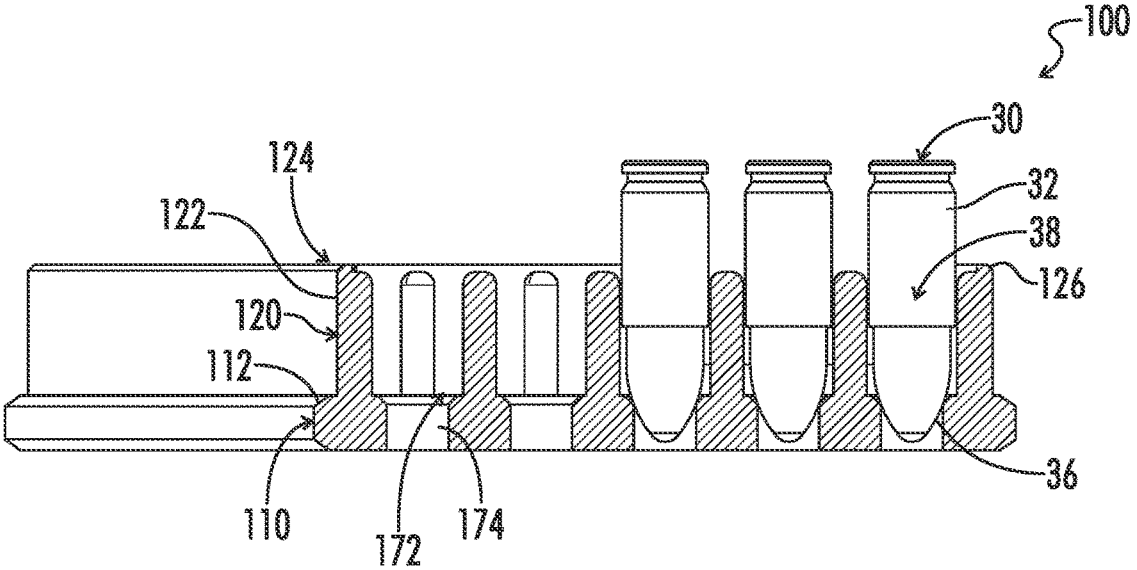
FIG. 19 is a cross-sectional view of the ammunition box filling tool apparatus of FIG. 17A taken along line 19-19 of FIG. 18 in accordance with the present disclosure.

As can best be seen in FIGS. 4, 12, and 18, the plurality of sectioned compartments 160 may be arranged in a square grid pattern 162 including a plurality of rows 164 and a plurality of columns 166 oriented perpendicularly to the plurality of rows 164. Each of the plurality of rows 164 may contain at least two sectioned compartments of the plurality of sectioned compartments 160. Each of the plurality of columns 166 may contain at least two sectioned compartments of the plurality of sectioned compartments 160. A total number of units of the plurality of units of ammunition 30 which may be received by the ammunition box filling tool apparatus 100 may be calculated by multiplying the total number of rows of the plurality of rows 164 and the total number of columns of the plurality of columns 166. Accordingly, the total number of units of the plurality of units of ammunition 30 may be adjusted by increasing or decreasing the total number of rows of the plurality of rows 164 and/or the total number of columns of the plurality of columns 166. Accordingly, the length 134 and the width 136 of the perimeter wall 120, or overall size of the ammunition box filling tool apparatus 100 in infinitely customizable depending on the particular type or caliber of the plurality of units of ammunition 30 and the size (or capacity) of the pre-folded card stock box 10. The pre-folded card stock box 10 is generally sized to hold 20, 25, 30, 50, or 100 units of ammunition of a given caliber.

Figure 8:
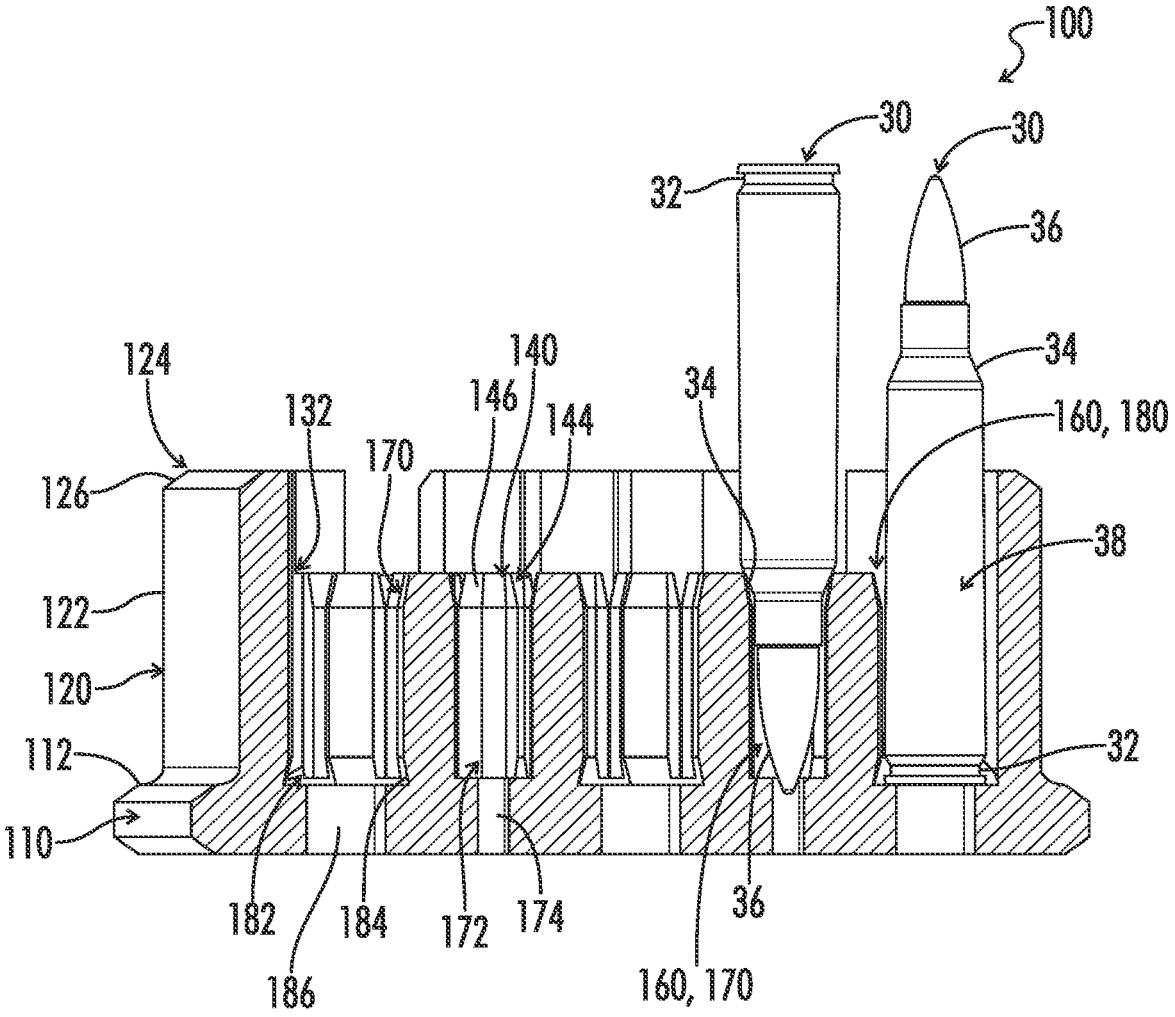
FIG. 8 is a cross-sectional view of the ammunition box filling tool apparatus of FIG. 1A taken along line 8-8 of FIG. 4 in accordance with the present disclosure.
Figure 9A:
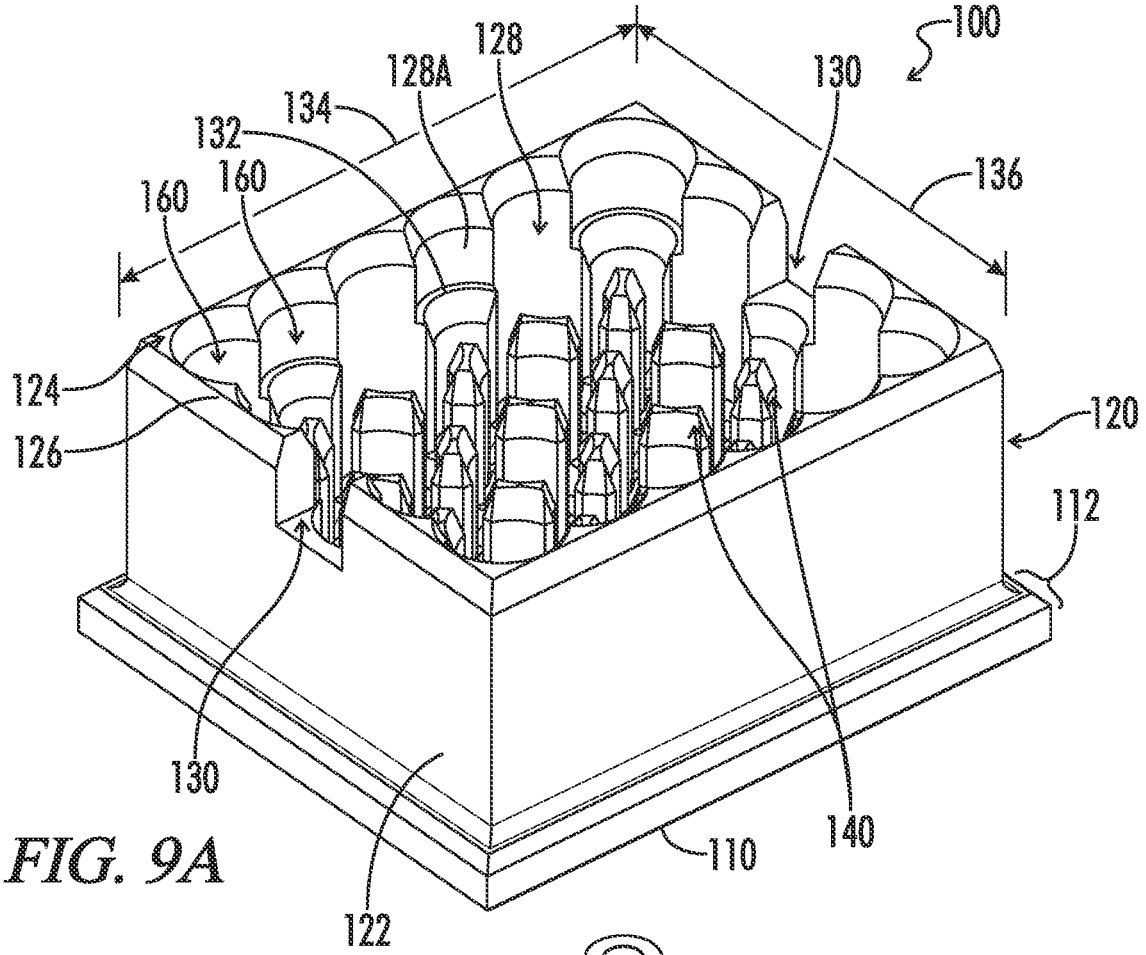
FIG. 9A is a perspective view of another embodiment of an ammunition box filling tool apparatus in accordance with the present disclosure.
Figure 9B:
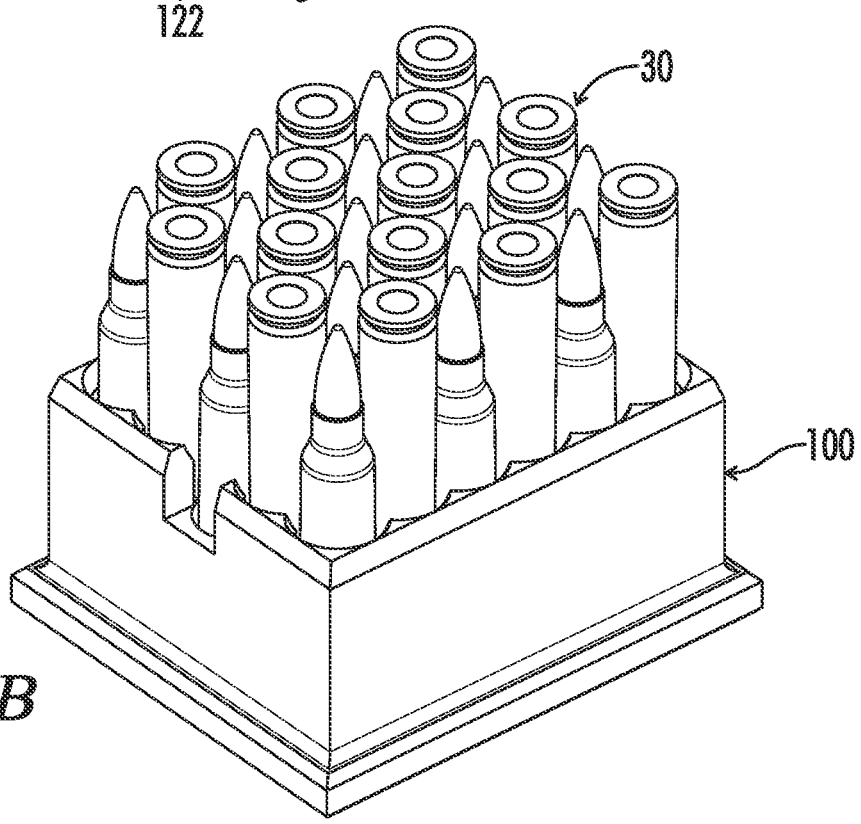
FIG. 9B is a perspective view of the ammunition box filling tool apparatus of FIG. 9A filled with ammunition in accordance with the present disclosure.
Figure 10:
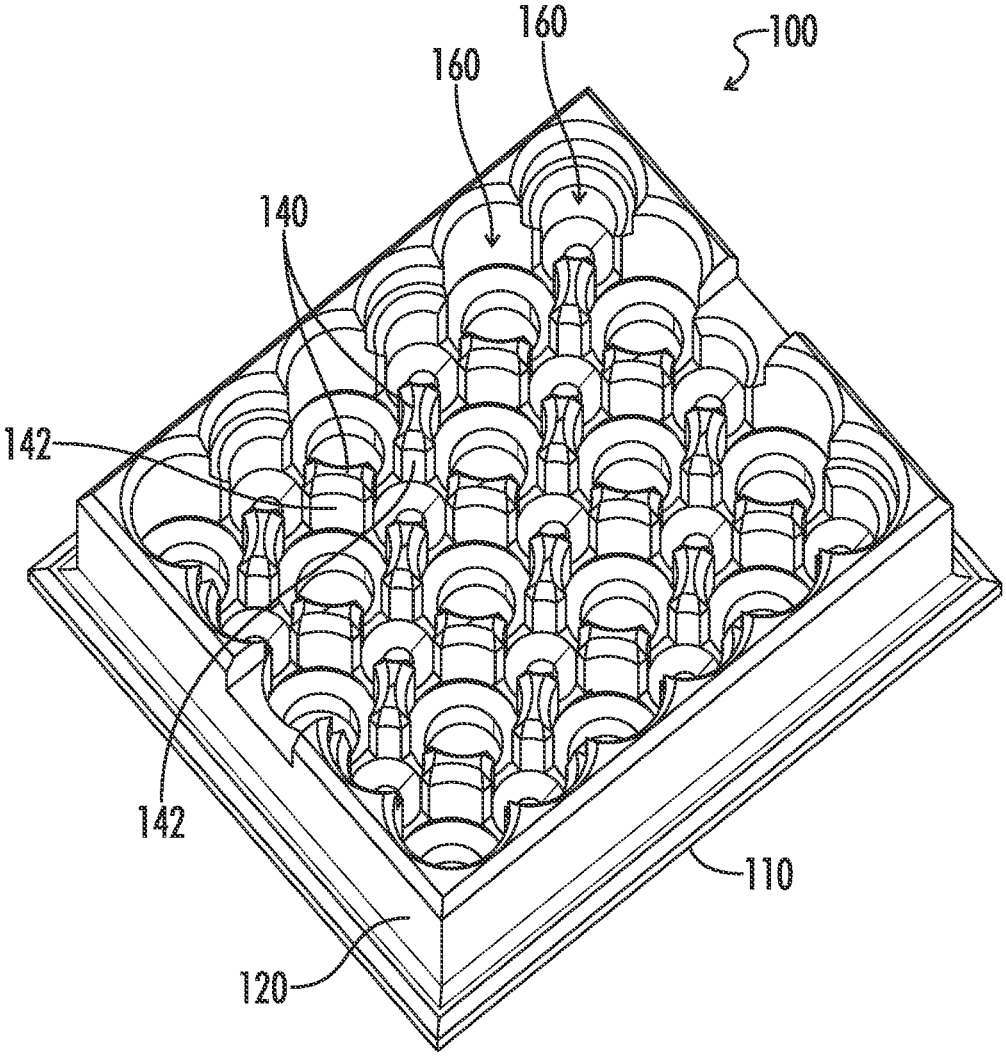
FIG. 10 is an elevated perspective view of the ammunition box filling tool apparatus of FIG. 9A in accordance with the present disclosure.
Figure 11:
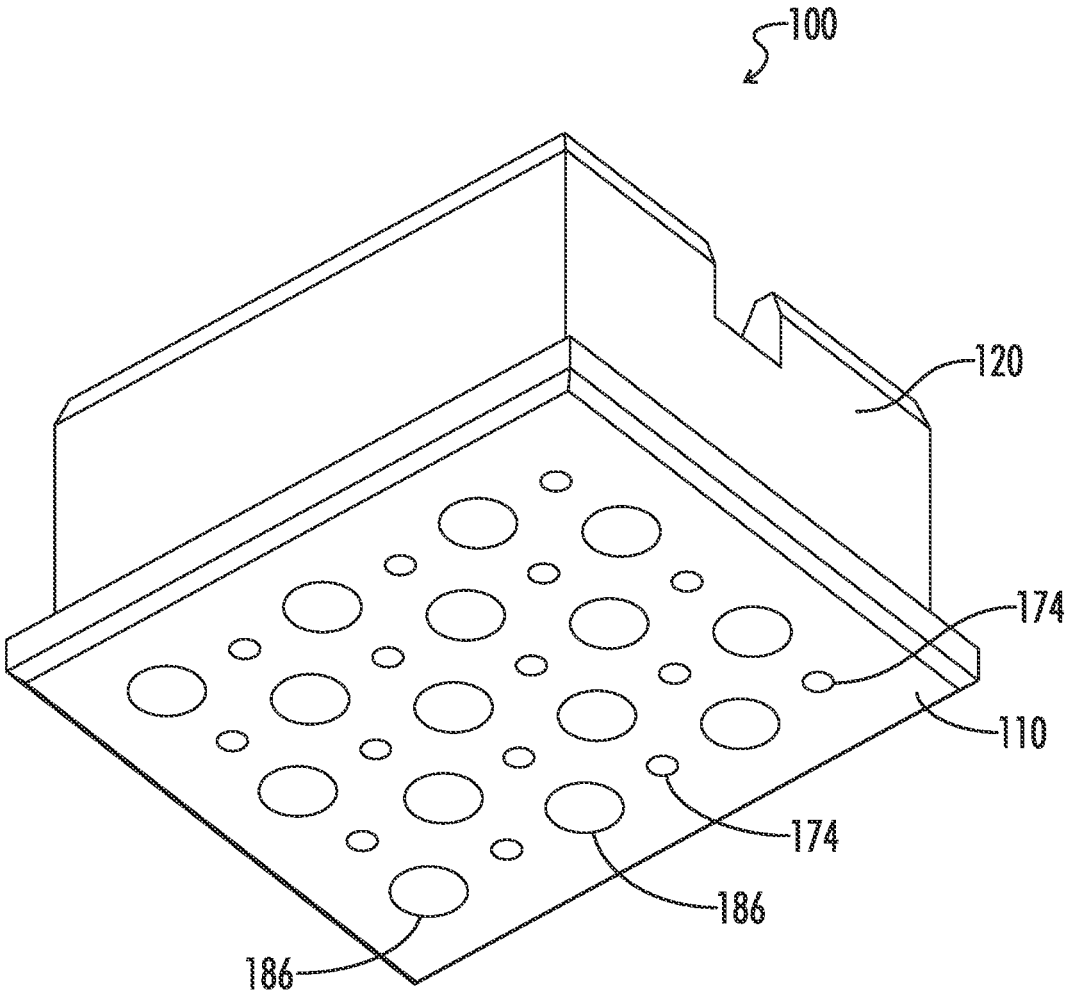
FIG. 11 is a bottom perspective view of the ammunition box filling tool apparatus of FIG. 9A in accordance with the present disclosure.

Each of the plurality of sectioned compartments 160 may be one of a first sectioned compartment type 170 or a second sectioned compartment type 180. As illustrated in FIG. 8, each sectioned compartment of the first sectioned compartment type 170 may be configured to receive the nose 36 of one of the plurality of units of ammunition 30. Each sectioned compartment of the second sectioned compartment type 180 may be configured to receive the base 32 of one of the plurality of units of ammunition 30.

Figure 16A:
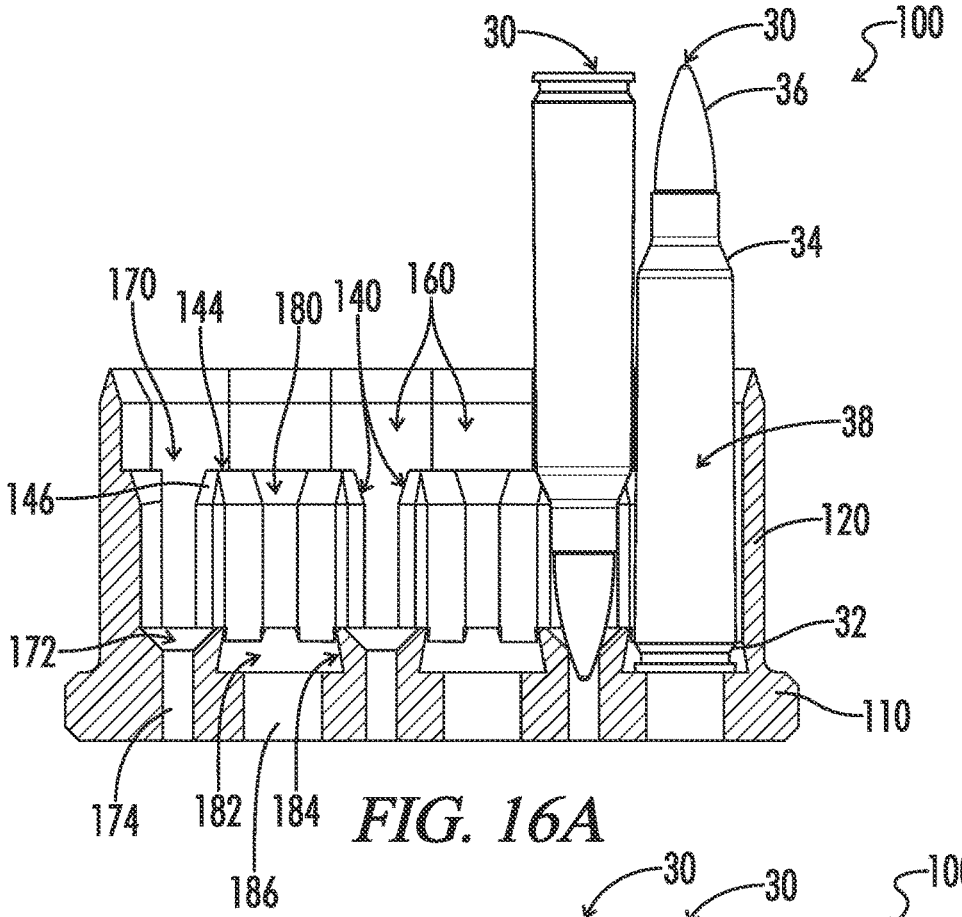
FIG. 16A is a cross-sectional view of the ammunition box filling tool apparatus of FIG. 9A taken along line 16A-16A of FIG. 12 in accordance with the present disclosure.
Figure 16B:
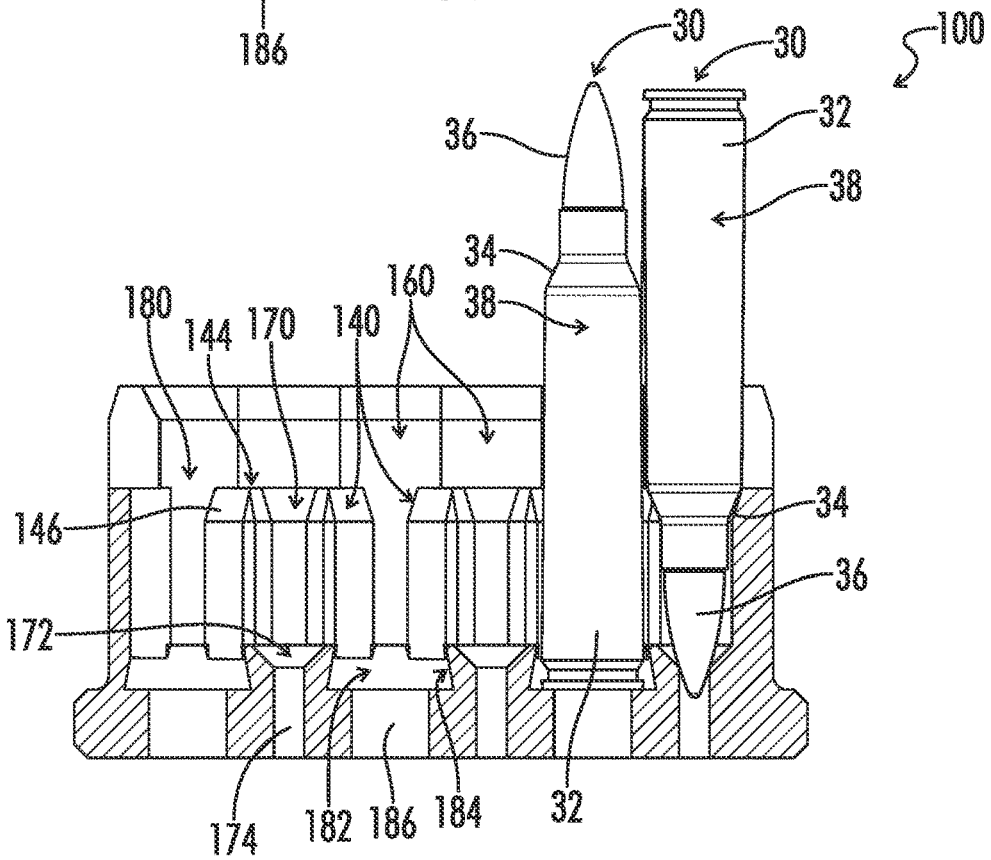
FIG. 16B is a cross-sectional view of the ammunition box filling tool apparatus of FIG. 9A taken along line 16B-16B of FIG. 12 in accordance with the present disclosure.
Figure 17A:
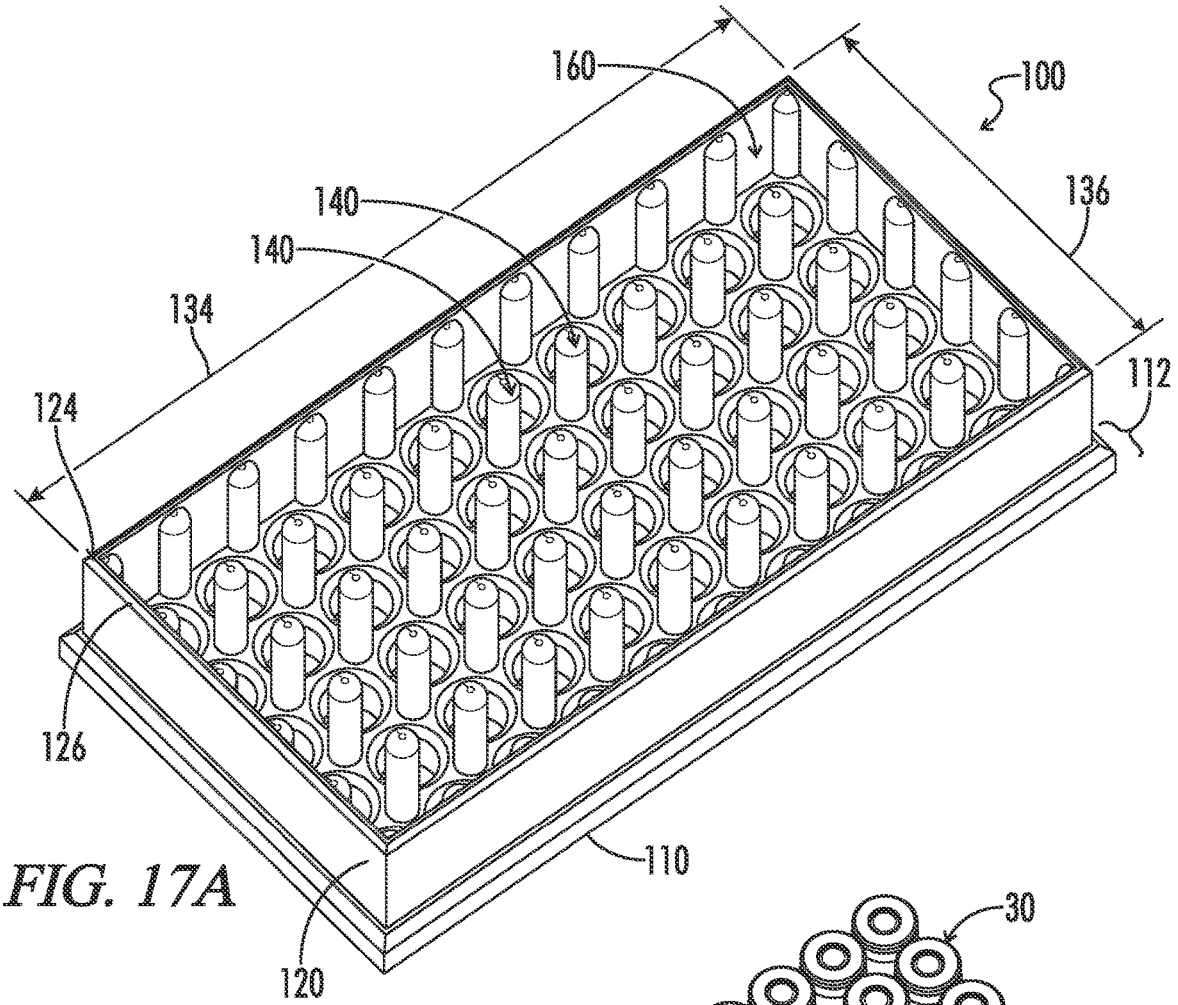
FIG. 17A is a perspective view of another embodiment of an ammunition box filling tool apparatus in accordance with the present disclosure.
Figure 17B:
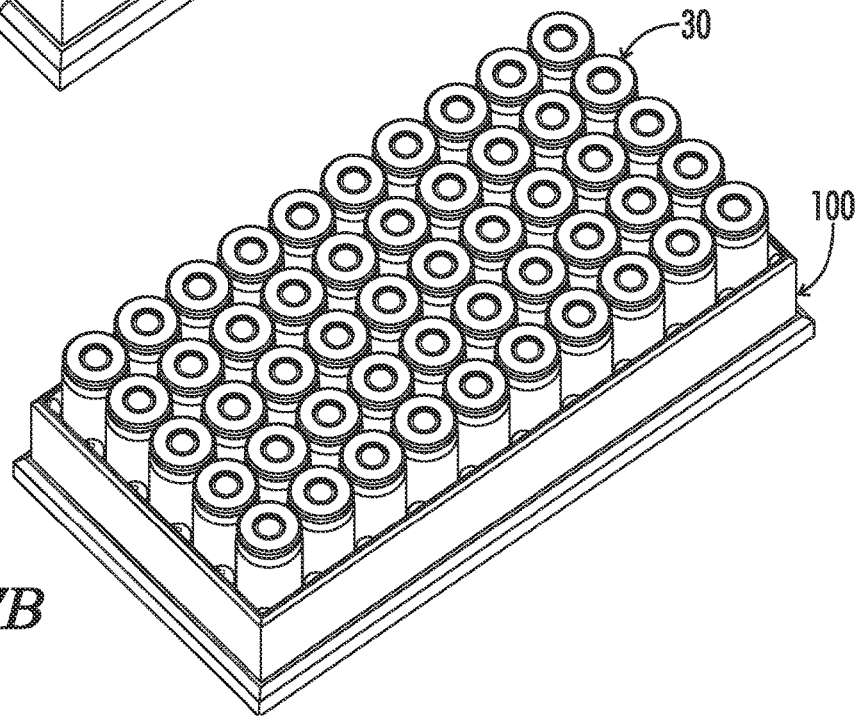
FIG. 17B is a perspective view of the ammunition box filling tool apparatus of FIG. 17A filled with ammunition in accordance with the present disclosure.

Referring to FIGS. 8 and 16A-16B, a bottom portion 172 of each sectioned compartment of the first sectioned compartment type 170 may be conically shaped for receiving the nose 36 of one of the plurality of units of ammunition 30 and centering the unit of ammunition within the first sectioned compartment type 170. The bottom portion 172 of may also be referred to herein as a conically shaped bottom portion 172. In certain optional embodiments, the conical shape of the bottom portion 172 may be a conically shaped hole. A bottom portion 182 of each sectioned compartment of the second sectioned compartment type 180 may in be flat and include a widened back-relief 184 to provide additional clearance for the base 32 of one of the plurality of units of ammunition 30. The widened back-relief 184 may be conically shaped upward toward the upper portion 124 of the perimeter wall 120.

More specifically, and especially applicable in the context of 3D printing, the widened back-relief 184 ensures that the base 32 of a unit of ammunition does not get stuck on a layer of plastic which may protrude into the section sectioned compartment type 180. For example, if the edges or hole of the section sectioned compartment type 180 surrounding the bottom portion 182 were straight all the way down, then melted plastic (e.g., used in 3D printing) may ooze into the hole of the section sectioned compartment type 180 and harden into a ledge which may catch the base 32 of a unit of ammunition and thus prevent that unit of ammunition from dropping out of the ammunition box filling tool apparatus 100 into the pre-folded card stock box 10.

The bottom portion 172 of each sectioned compartment of the first sectioned compartment type 170 may be positioned closer to the upper portion 124 of the perimeter wall 120 than the bottom portion 182 of each sectioned compartment of the second sectioned compartment type 180. The bottom portions 172, 182 of each of the first and second sectioned compartment types 170, 180 may include a hole 174, 186, respectively, defined through the base portion 110. The holes 174, 186 may also be referred to herein as sighting holes 174, 186. The holes 174 associated with the sectioned compartments of the first sectioned compartment type 170 may be smaller (e.g., have a smaller radius, diameter, and/or circumference) than the holes 186 associated with the sectioned compartments of the first sectioned compartment type 170. This size differentiation may, at least in part, be due to the conically shaped bottom portion 172 of the sectioned compartments of the first sectioned compartment type 170.

The holes 174, 186 may allow a user to check whether all of the plurality of units of ammunition 30 were successfully transferred from the ammunition box filling tool apparatus 100 into the pre-folded card stock box 10, as discussed below. The holes 174, 186 may also aid in the removable of any units of ammunition lodged within the ammunition box filling tool apparatus 100 while transferring the plurality of units of ammunition 30 from the ammunition box filling tool apparatus 100 into the pre-folded card stock box 10.

A portion of each of the perimeter wall 120 (e.g., portions of the interior surface 128) and/or the plurality of fingers 140 used to define each sectioned compartment of the first or second sectioned compartment types 170, 180 may be curved to match a portion of the cylindrical shape 38 of each of the units of ammunition 30. For example, these portions may be curved to match the cylindrical shape 38 of each of the units of ammunition 30 defined between the shoulder 34 and one of the base 32 or the nose 36.

Referring to 8 and 16A-16B, an upper end 144 of each of the plurality of fingers 140 may include a tapered portion 146. In certain optional embodiments, the entirety of the upper end 144 may be tapered. The tapered portion 146 may face or be angled toward sectioned compartments of the first sectioned compartment type 170 and may further be configured to receive the shoulder 34 of one of the plurality of units of ammunition 30. The tapered portions 146 of the plurality of fingers 140 in conjunction with the conically shaped bottom portion 172 may be used to stabilize each of the plurality of units of ammunition 30 received by sectioned compartments of the first sectioned compartment type 170.

Certain sectioned compartments of the first section compartment type 170 may be defined using both a portion 128A of the interior surface 128 of the perimeter wall 120 and two of the plurality of fingers 140. In certain optional embodiments, the portion 128A of the interior surface 128 of the perimeter wall 120 used to at least in part define a sectioned compartment of the first sectioned compartment type 170 may include a curved ledge 132 configured to receive the shoulder 34 of one of the plurality of units of ammunition 30.

As illustrated in 8 and 16A-16B, the tapered portion 146 and the curved ledge 138 may be positioned closer to the upper portion 124 of the perimeter wall 120 than to the base portion 110. In other optional embodiments (not shown), the tapered portion 146 and the curved ledge 138 may be positioned closer to the base portion 110 than to the upper portion 124 of the perimeter wall 120.

Referring to FIGS. 1A-8, the plurality of sectioned compartments 160 within each row of the plurality of rows 164 may all be one of the first sectioned compartment type 170 or the second sectioned compartment type 180. As illustrated, the square grid pattern 162 of the plurality of compartments 160 may be at least partially defined by alternating from sectioned compartments of the first sectioned compartment type 170 to sectioned compartments of the second sectioned compartment type 180 between adjacent rows of the plurality of rows 164. Likewise, this pattern could be implemented using columns instead of rows. This particular pattern may be useful for units of ammunition 30 that do not include the shoulder 34, such as, for example, 300 blk or the like. In certain optional embodiments (not shown), an analogous pattern could be implemented by having multiple adjacent rows of sectioned compartments of the first sectioned compartment type 170 followed by multiple adjacent rows of sectioned compartments of the second sectioned compartment type 180.

Referring to FIGS. 9A-16B, the square grid pattern 162 of the plurality of compartments 160 may be at least partially defined by alternating between the first sectioned compartment type 170 and the second sectioned compartment type 180 within each row of the plurality of rows 164 and within each column of the plurality of columns 166. This particular pattern may be useful for units of ammunition 30 that include the shoulder 34.

Referring to FIGS. 17A-19, the plurality of sectioned compartments 160 may all be of the first sectioned compartment type 170. This may be particularly applicable for units of ammunition 30 that do not include the shoulder 34, such as, for example, pistol caliber cartridges or the like which include a uniform diameter except for the nose 36. In other optional embodiments (not shown), the plurality of sectioned compartments 160 may all be of the second sectioned compartment type 180.

As illustrated in FIGS. 8, 16A, and 16B, the base 32 and nose 36 of each of the plurality of units of ammunition 30 received by the second sectioned compartment type 180 align with the nose 36 and base 32, respectively, of each of the plurality of units of ammunition 30 received by the first sectioned compartment type 170.

Figure 21:
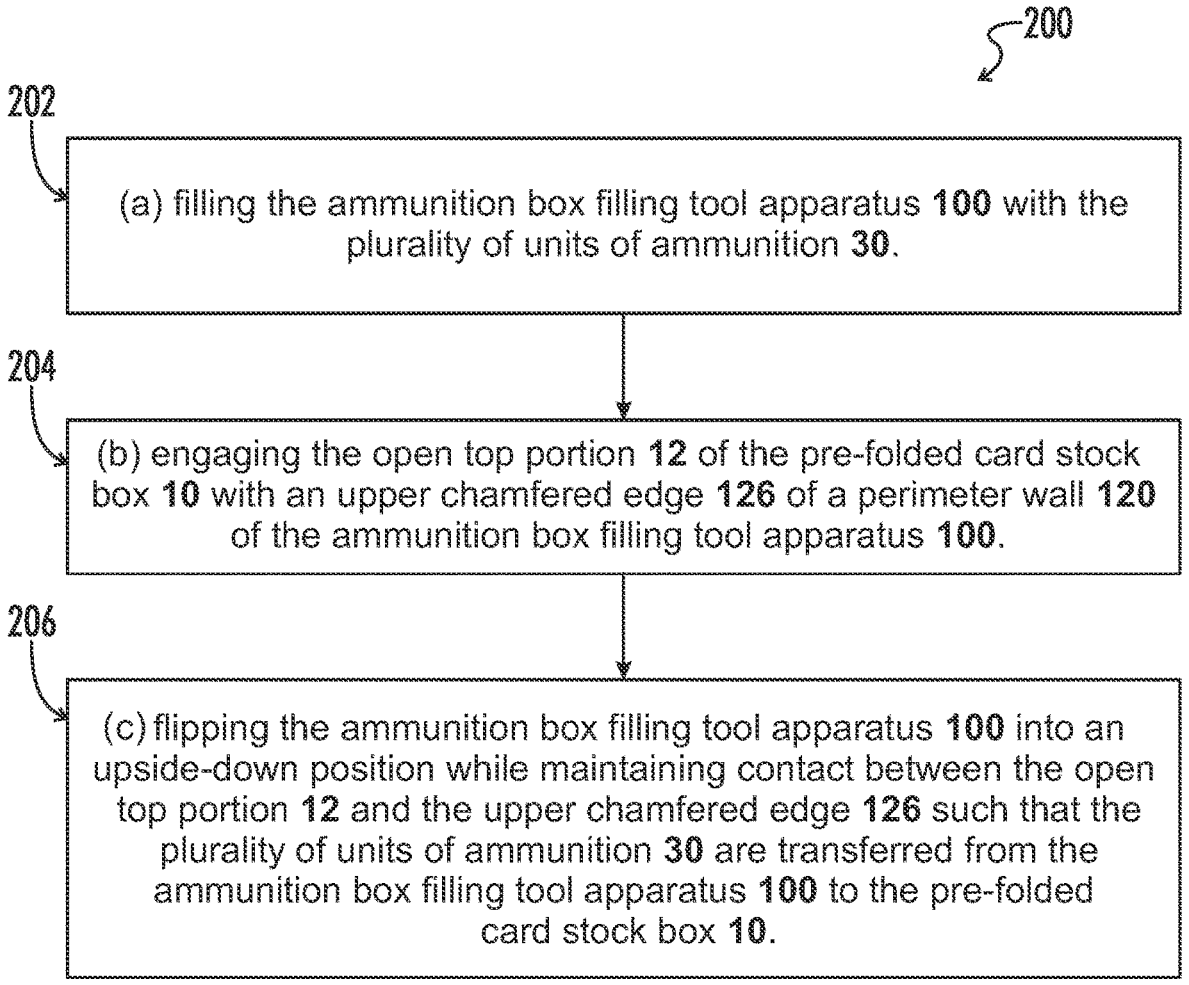
FIG. 21 is a flow chart of a method of loading a pre-folded card stock box having an open top portion with a plurality of units of ammunition using an ammunition box filling tool apparatus in accordance with the present disclosure.

Referring to FIG. 21, a method 200 of loading a pre-folded card stock box 10 having an open top portion 12 with a plurality of units of ammunition 30 using an ammunition box filling tool apparatus 100. The method 200 may comprise step (a) filling 202 the ammunition box filling tool apparatus 100 with the plurality of units of ammunition 30. The method 200 may further comprise step (b) engaging 204 the open top portion 12 of the pre-folded card stock box 10 with an upper chamfered edge 126 of a perimeter wall 120 of the ammunition box filling tool apparatus 100. The method 200 may further comprise step (c) flipping 206 the ammunition box filling tool apparatus 100 into an upside-down position, while maintaining contact between the open top portion 12 and the upper chamfered edge 126 such that the plurality of units of ammunition 30 are received by the pre-folded card stock box 10.

In certain optional embodiments, the method 200 may further include, following step (c), disengaging the ammunition box filling tool apparatus 100 from the pre-folded card stock box 10 and folding closed the open top portion 12 of the pre-folded card stock box 10.

In some optional embodiments, step (a) of the method 200 may further include positioning each of the plurality of units of ammunition 30 in one of a plurality of sectioned compartments 160 of the ammunition box filling tool apparatus 100. In accordance with this embodiment, each of the plurality of sectioned compartments 160 may be defined by at least one of the perimeter wall 120 or one or more of a plurality of fingers 140 of the ammunition box filling tool apparatus 100.

In other optional embodiments, step (a) of the method 200 may further include receiving a nose 36 of each of the plurality of units of ammunition 30 into sectioned compartments of a first sectioned compartment type 170 of the plurality of section compartments 160.

In further optional embodiments, step (a) of the method 200 may further include receiving a base 32 of each of the plurality of units of ammunition 30 into sectioned compartments of a second sectioned compartment type 180 of the plurality of section compartments 160.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

Although embodiments of the present invention have been described in detail, it will be understood by those skilled in the art that various modifications can be made therein without departing from the spirit and scope of the invention as set forth in the appended claims.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

The previous detailed description has been provided for the purposes of illustration and description. Thus, although there have been described particular embodiments of a new and useful invention, it is not intended that such references be construed as limitations upon the scope of this disclosure except as set forth in the following claims.

What is claimed is:

1. An ammunition box filling tool apparatus for filling an ammunition box having an open top portion, wherein the ammunition box has dimensions corresponding to the open top portion, with a plurality of units of ammunition, the ammunition box filling tool apparatus comprising:

a base portion;

a continuous perimeter wall extending upwardly from the base portion, wherein the continuous perimeter wall has dimensions greater than or equal to the dimensions of the ammunition box;

a plurality of fingers extending upwardly from the base portion and surrounded by the continuous perimeter wall; and a plurality of sectioned compartments defined by at least one of the continuous perimeter wall or one or more of the plurality of fingers, each of the plurality of sectioned compartments configured to receive one of the plurality of units of ammunition.

2. The ammunition box filling tool apparatus of claim 1, wherein:

at least one of the plurality of sectioned compartments is defined at least in part by a portion of an interior surface of the continuous perimeter wall.

3. The ammunition box filling tool apparatus of claim 1, wherein:

the continuous perimeter wall includes an exterior surface having an upper edge configured to engage at least a portion of the open top portion of the ammunition box.

4. The ammunition box filling tool apparatus of claim 1, wherein:

the plurality of sectioned compartments is arranged in a grid pattern including a plurality of rows and a plurality of columns.

5. The ammunition box filling tool apparatus of claim 4, wherein:

each of the plurality of sectioned compartments is one of a first sectioned compartment type or a second sectioned compartment type;

the first sectioned compartment type is configured to receive a nose of one of the plurality of units of ammunition; and the second sectioned compartment type is configured to receive a base of the one of the plurality of units of ammunition.

6. The ammunition box filling tool apparatus of claim 5, wherein:

a bottom portion of the first sectioned compartment type is contoured to match a portion of a shape of the nose of one of the plurality of units of ammunition;

a bottom portion of the second sectioned compartment type is contoured to match a portion of a shape of the base of one of the plurality of units of ammunition.

7. The ammunition box filling tool apparatus of claim 6, wherein:

the bottom portion of the first sectioned compartment type is positioned closer to an upper edge of the continuous perimeter wall than the bottom portion of the second sectioned compartment type.

8. The ammunition box filling tool apparatus of claim 6, wherein:

the bottom portions of each of the first and second sectioned compartment types includes a hole, respectively, defined through the base portion; and the hole of the first sectioned compartment type is smaller than the hole of the second sectioned compartment type.

9. The ammunition box filling tool apparatus of claim 5, wherein:

a portion of each of the continuous perimeter wall or the plurality of fingers used to define one of the first sectioned compartment type or the second sectioned compartment type is contoured to match a portion of a shape of each of the plurality of units of ammunition.

10. The ammunition box filling tool apparatus of claim 9, wherein:

an upper end of each of the plurality of fingers includes a tapered portion facing the first sectioned compartment type and configured to receive a shoulder of one of the plurality of units of ammunition; and the portion of the continuous perimeter wall used to define the first sectioned compartment type includes a ledge configured to receive the shoulder of one of the plurality of units of ammunition.

11. The ammunition box filling tool apparatus of claim 5, wherein:

the plurality of sectioned compartments within each row of the plurality of rows are all of one of the first sectioned compartment type or the second sectioned compartment type; and the grid pattern is at least partially defined by alternating from the first sectioned compartment type to the second sectioned compartment type between adjacent rows of the plurality of rows.

12. The ammunition box filling tool apparatus of claim 5, wherein:

the grid pattern is at least partially defined by alternating between the first and second sectioned compartment types within each row of the plurality of rows and within each column of the plurality of columns.

13. The ammunition box filling tool apparatus of claim 5, wherein:

the plurality of sectioned compartments is either all of the first sectioned compartment type or all of the second sectioned compartment type.

14. The ammunition box filling tool apparatus of claim 1, wherein:

each of the plurality of fingers includes a plurality of sidewalls.

15. The ammunition box filling tool apparatus of claim 1, wherein:

the continuous perimeter wall includes a pair of cutaway portions positioned along a portion of the continuous perimeter wall opposite each other, the pair of cutaway portions defined between an interior surface and an exterior surface of the continuous perimeter wall; and the pair of cutaway portions are configured to provide clearance for portions of a pair of interlocking arms of the ammunition box that extend above the open top portion.

* * * * *